US009273251B2

(12) United States Patent
White et al.

(10) Patent No.: US 9,273,251 B2
(45) Date of Patent: Mar. 1, 2016

(54) RF HEATING TO REDUCE THE USE OF SUPPLEMENTAL WATER ADDED IN THE RECOVERY OF UNCONVENTIONAL OIL

(75) Inventors: John White, Melbourne, FL (US); Francis Eugene Parsche, Palm Bay, FL (US); Victor Hernandez, Merritt Island, FL (US); Derik T. Ehresman, Indialantic, FL (US); Mark E. Blue, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 1105 days.

(21) Appl. No.: 13/332,946

(22) Filed: Dec. 21, 2011

(65) Prior Publication Data

US 2012/0097578 A1 Apr. 26, 2012

Related U.S. Application Data

(62) Division of application No. 12/395,918, filed on Mar. 2, 2009, now Pat. No. 8,128,786.

(51) Int. Cl.
*C10G 32/04* (2006.01)
*C10G 1/04* (2006.01)

(52) U.S. Cl.
CPC ..... *C10G 1/04* (2013.01); *C10G 2300/805* (2013.01)

(58) Field of Classification Search
CPC ..... C10G 1/04; C10G 2300/805
USPC ..... 208/390, 391, 402
See application file for complete search history.

(56) References Cited

U.S. PATENT DOCUMENTS

| | | | |
|---|---|---|---|
| 2,371,459 | A | 3/1945 | Mittelmann |
| 2,685,930 | A | 8/1954 | Albaugh |
| 3,497,005 | A | 2/1970 | Pelopsky |
| 3,848,671 | A | 11/1974 | Kern |
| 3,954,140 | A | 5/1976 | Hendrick |

(Continued)

FOREIGN PATENT DOCUMENTS

| | | |
|---|---|---|
| CA | 1199573 | 1/1986 |
| CA | 2678473 | 8/2009 |

(Continued)

OTHER PUBLICATIONS

The RF Transmission Systems Handbook, Ch. 16-17, Whitaker ed., 2002, ISBN 978-0-8493-0973-1.*

(Continued)

*Primary Examiner* — Prem C Singh
*Assistant Examiner* — Brandi M Doyle
(74) *Attorney, Agent, or Firm* — Allen, Dyer, Doppelt, Milbrath & Gilchrist, P.A.

(57) ABSTRACT

Equipment and a process for separating bitumen from oil sand in a process stream are described. The equipment includes several processing vessels and one or more local area radio frequency applicators to selectively heat the process stream in local areas of the equipment. The local area can be adjacent to an input or output of a component of the equipment. Also described is equipment for processing an oil sand—water slurry, including a slurrying vessel, a slurry pipe, and a local area radio frequency applicator. The local area radio frequency applicator is located outside of the slurry pipe, and heats the local area without significantly heating the contents of the slurrying vessel or of the downstream portion of the slurry pipe.

20 Claims, 13 Drawing Sheets

(56) References Cited

U.S. PATENT DOCUMENTS

| | | | | |
|---|---|---|---|---|
| 3,988,036 | A | 10/1976 | Fisher | |
| 3,991,091 | A | 11/1976 | Driscoll | |
| 4,035,282 | A | 7/1977 | Stuchberry et al. | |
| 4,042,487 | A | 8/1977 | Seguchi | |
| 4,087,781 | A | 5/1978 | Grossi et al. | |
| 4,116,809 | A * | 9/1978 | Kizior | 208/425 |
| 4,136,014 | A | 1/1979 | Vermeulen | |
| 4,140,179 | A | 2/1979 | Kasevich et al. | |
| 4,140,180 | A | 2/1979 | Bridges et al. | |
| 4,144,935 | A | 3/1979 | Bridges et al. | |
| 4,146,125 | A | 3/1979 | Sanford et al. | |
| 4,196,329 | A | 4/1980 | Rowland et al. | |
| 4,295,880 | A | 10/1981 | Horner | |
| 4,300,219 | A | 11/1981 | Joyal | |
| 4,301,865 | A | 11/1981 | Kasevich et al. | |
| 4,328,324 | A | 5/1982 | Kock | |
| 4,373,581 | A | 2/1983 | Toellner | |
| 4,396,062 | A | 8/1983 | Iskander | |
| 4,404,123 | A | 9/1983 | Chu | |
| 4,410,216 | A | 10/1983 | Allen | |
| 4,425,227 | A | 1/1984 | Smith | |
| 4,449,585 | A | 5/1984 | Bridges et al. | |
| 4,456,065 | A | 6/1984 | Heim | |
| 4,457,365 | A | 7/1984 | Kasevich et al. | |
| 4,470,459 | A | 9/1984 | Copland | |
| 4,485,869 | A | 12/1984 | Sresty | |
| 4,487,257 | A | 12/1984 | Dauphine | |
| 4,508,168 | A | 4/1985 | Heeren | |
| 4,514,305 | A | 4/1985 | Filby | |
| 4,524,827 | A | 6/1985 | Bridges | |
| 4,531,468 | A | 7/1985 | Simon | |
| 4,583,586 | A | 4/1986 | Fujimoto et al. | |
| 4,620,593 | A | 11/1986 | Haagensen | |
| 4,622,496 | A | 11/1986 | Dattili | |
| 4,645,585 | A | 2/1987 | White | |
| 4,678,034 | A | 7/1987 | Eastlund | |
| 4,703,433 | A | 10/1987 | Sharrit | |
| 4,790,375 | A | 12/1988 | Bridges | |
| 4,817,711 | A | 4/1989 | Jeambey | |
| 4,882,984 | A | 11/1989 | Eves, II | |
| 4,892,782 | A | 1/1990 | Fisher et al. | |
| 5,046,559 | A | 9/1991 | Glandt | |
| 5,055,180 | A | 10/1991 | Klaila | |
| 5,065,819 | A | 11/1991 | Kasevich | |
| 5,082,054 | A | 1/1992 | Kiamanesh | |
| 5,136,249 | A | 8/1992 | White | |
| 5,199,488 | A | 4/1993 | Kasevich | |
| 5,233,306 | A | 8/1993 | Misra | |
| 5,236,039 | A | 8/1993 | Edelstein | |
| 5,251,700 | A | 10/1993 | Nelson | |
| 5,293,936 | A | 3/1994 | Bridges | |
| 5,304,767 | A | 4/1994 | McGaffigan | |
| 5,315,561 | A | 5/1994 | Grossi | |
| 5,370,477 | A | 12/1994 | Bunin | |
| 5,378,879 | A | 1/1995 | Monovoukas | |
| 5,506,592 | A | 4/1996 | MacDonald | |
| 5,582,854 | A | 12/1996 | Nosaka | |
| 5,621,844 | A | 4/1997 | Bridges | |
| 5,631,562 | A | 5/1997 | Cram | |
| 5,746,909 | A | 5/1998 | Calta | |
| 5,910,287 | A | 6/1999 | Cassin | |
| 5,923,299 | A | 7/1999 | Brown et al. | |
| 6,045,648 | A | 4/2000 | Palmgren et al. | |
| 6,046,464 | A | 4/2000 | Schetzina | |
| 6,055,213 | A | 4/2000 | Rubbo | |
| 6,063,338 | A | 5/2000 | Pham | |
| 6,097,262 | A | 8/2000 | Combellack | |
| 6,106,895 | A | 8/2000 | Usuki | |
| 6,110,359 | A | 8/2000 | Davis et al. | 208/390 |
| 6,112,273 | A | 8/2000 | Kau | |
| 6,184,427 | B1 | 2/2001 | Klepfer | |
| 6,229,603 | B1 | 5/2001 | Coassin | |
| 6,232,114 | B1 | 5/2001 | Coassin | |
| 6,301,088 | B1 | 10/2001 | Nakada | |
| 6,303,021 | B2 | 10/2001 | Winter | |
| 6,348,679 | B1 | 2/2002 | Ryan et al. | |
| 6,360,819 | B1 | 3/2002 | Vinegar | |
| 6,432,365 | B1 | 8/2002 | Levin | |
| 6,603,309 | B2 | 8/2003 | Forgang | |
| 6,613,678 | B1 | 9/2003 | Sakaguchi | |
| 6,614,059 | B1 | 9/2003 | Tsujimura | |
| 6,649,888 | B2 | 11/2003 | Ryan et al. | |
| 6,712,136 | B2 | 3/2004 | De Rouffignac | |
| 6,808,935 | B2 | 10/2004 | Levin | |
| 6,923,273 | B2 | 8/2005 | Terry | |
| 6,932,155 | B2 | 8/2005 | Vinegar | |
| 6,967,589 | B1 | 11/2005 | Peters | |
| 6,992,630 | B2 | 1/2006 | Parsche | |
| 7,046,584 | B2 | 5/2006 | Sorrells | |
| 7,079,081 | B2 | 7/2006 | Parsche et al. | |
| 7,091,460 | B2 | 8/2006 | Kinzer | |
| 7,109,457 | B2 | 9/2006 | Kinzer | |
| 7,115,847 | B2 | 10/2006 | Kinzer | 219/772 |
| 7,147,057 | B2 | 12/2006 | Steele | |
| 7,172,038 | B2 | 2/2007 | Terry | |
| 7,205,947 | B2 | 4/2007 | Parsche | |
| 7,312,428 | B2 | 12/2007 | Kinzer | |
| 7,322,416 | B2 | 1/2008 | Burris, II | |
| 7,337,980 | B2 | 3/2008 | Schaedel | |
| 7,438,807 | B2 | 10/2008 | Garner et al. | |
| 7,441,597 | B2 | 10/2008 | Kasevich | |
| 7,461,693 | B2 | 12/2008 | Considine et al. | |
| 7,484,561 | B2 | 2/2009 | Bridges | |
| 7,562,708 | B2 | 7/2009 | Cogliandro | |
| 7,623,804 | B2 | 11/2009 | Sone | |
| 7,631,691 | B2 | 12/2009 | Symington et al. | 166/248 |
| 7,694,829 | B2 | 4/2010 | Veltri et al. | 210/521 |
| 2002/0032534 | A1 | 3/2002 | Regier | |
| 2004/0031731 | A1 | 2/2004 | Honeycutt | |
| 2005/0199386 | A1 | 9/2005 | Kinzer | |
| 2005/0274513 | A1 | 12/2005 | Schultz | |
| 2006/0038083 | A1 | 2/2006 | Criswell | |
| 2006/0038730 | A1 * | 2/2006 | Parsche | 343/741 |
| 2007/0108202 | A1 | 5/2007 | Kinzer | |
| 2007/0131591 | A1 | 6/2007 | Pringle | |
| 2007/0137852 | A1 | 6/2007 | Considine et al. | |
| 2007/0137858 | A1 | 6/2007 | Considine et al. | |
| 2007/0187089 | A1 | 8/2007 | Bridges | |
| 2007/0261844 | A1 | 11/2007 | Cogliandro et al. | |
| 2008/0073079 | A1 | 3/2008 | Tranquilla | |
| 2008/0111096 | A1 | 5/2008 | Veltri et al. | |
| 2008/0143330 | A1 | 6/2008 | Madio | |
| 2009/0009410 | A1 | 1/2009 | Dolgin et al. | |
| 2009/0242196 | A1 | 10/2009 | Pao | |

FOREIGN PATENT DOCUMENTS

| | | |
|---|---|---|
| CN | 1775911 | 5/2006 |
| DE | 10 2008 02217 | 11/2009 |
| EP | 0135966 | 4/1985 |
| EP | 0418117 | 3/1991 |
| EP | 0563999 | 10/1993 |
| EP | 1106672 | 6/2001 |
| FR | 1586066 | 2/1970 |
| FR | 2925519 | 6/2009 |
| JP | 56050119 | 5/1981 |
| JP | 2246502 | 10/1990 |
| WO | 2007102819 | 9/2007 |
| WO | 2007/133461 | 11/2007 |
| WO | 2008/011412 | 1/2008 |
| WO | 2008/030337 | 3/2008 |
| WO | 2008/098850 | 8/2008 |
| WO | 2009/027262 | 3/2009 |
| WO | 2009/114934 | 9/2009 |

OTHER PUBLICATIONS

U.S. Appl. No. 12/886,338, filed Sep. 20, 2010, Parsche (not yet published).

Butler, R.M. "Theoretical Studies on the Gravity Drainage of Heavy Oil During In-Situ Steam Heating", Can J. Chern Eng, vol. 59,1981, pp. 1-6.

(56) References Cited

OTHER PUBLICATIONS

Butler, R. and Mokrys, 1., "A New Process (VAPEX) for Recovering Heavy Oils Using Hot Water and Hydrocarbon Vapour", Journal of Canadian Petroleum Technology, 30(1 ), 1991, pp. 97-106.
Butler, R. and Mokrys, 1., "Recovery of Heavy Oils Using Vapourized Hydrocarbon Solvents: Further Development of the VAPEX Process", Journal of Canadian Petroleum Technology, 32(6), 1993, pp. 56-62.
Butler, R. and Mokrys, 1., "Closed Loop Extraction Method for the Recovery of Heavy Oils and Bitumens Underlain by Aquifers: the VAPEX Process", Journal of Canadian Petroleum Technology, 37(4), 1998, pp. 41-50.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995, pp. 1-16.
Das, S.K. and Butler, R.M., "Diffusion Coefficients of Propane and Butane in Peace River Bitumen" Canadian Journal of Chemical Engineering, 74,988-989, Dec. 1996 pp. 1-8.
Das, S.K. and Butler, R.M., "Mechanism of the Vapour Extraction Process for Heavy Oil and Bitumen", Journal of Petroleum Science and Engineering, 21, 1998, pp. 43-59.
Dunn, S.G., Nenniger, E. and Rajan, R., "A Study of Bitumen Recovery by Gravity Drainage Using Low Temperature Soluble Gas Injection", Canadian Journal of Chemical Engineering, 67, Dec. 1989, pp. 978-991.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 1998, pp. 17-24.
Mokrys, 1., and Butler, R., "In Situ Upgrading of Heavy Oils and Bitumen by Propane Deasphalting: The VAPEX 11 Process", SPE 25452, presented at the SPE Production Operations Symposium held in Oklahoma City OK USA, D Mar. 21-23, 1993, pp. 1-16.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008, pp. 1-14.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta D Canada, Jun. 16-18, 2009, pp. 1-16.
Bridges, J.E., Sresty, G.C., Spencer, H.L. and Wattenbarger, R.A., "Electromagnetic Stimulation of Heavy Oil Wells", 14, Third International Conference on Heavy Oil Crude and Tar Sands, UNITAR/UNDP, Long Beach D California, USA Jul. 22-31, 1985, pp. 1221-1232.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008, p. 1.
Carrizales, M. and Lake, L.W., "Two-Dimensional Comsol Simulation of Heavy-Oil Recovery by Electromagnetic Heating", Proceedings of the COMSOL Conference Boston, 2009, pp. 1-7.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992, pp. 1-10.
Chhetri, A.B. and Islam, M.R., "A Critical Review of Electromagnetic Heating for Enhanced Oil Recovery", Petroleum Science and Technology, 26(14), 2008, pp. 1619-1631.
Chute, F.S., Vermeulen, F.E., Cervenan, M.R. and McVea, F.J., "Electrical Properties of Athabasca Oil Sands", Canadian Journal of Earth Science, 16, 1979, pp. 2009-2021.
Davidson, R.J., "Electromagnetic Stimulation of Lloydminster Heavy Oil Reservoirs", Journal of Canadian Petroleum Technology, 34(4), 1995, pp. 15-24.
Hu, Y., Jha, K.N. and Chakma, A., "Heavy-Oil Recovery from Thin Pay Zones by Electromagnetic Heating", Energy Sources, 21(1-2), 1999, pp. 63-73.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994, pp. 1-15.
Koolman, M., Huber, N., Diehl, D. and Wacker, B., "Electromagnetic Heating Method to Improve Steam Assisted /N.B./ 23 Gravity Drainage", SPE117481, presented at the 2008 SPE International Thermal Operations and Heavy Oil Symposium held in Calgary, Alberta, Canada, Oct. 20-23, 2008, pp. 1-13.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermo Physics, 77(6), 2004, pp. 1184-1191.
McGee, B.C.W. and Donaldson, RD., "Heat Transfer Fundamentals for Electro-thermal Heating of Oil Reservoirs", CIPC 2009-024, presented at the Canadian International Petroleum Conference, held in Calgary, Alberta, Canada, Jun. 16-18, 2009, pp. 1-16.
Ovalles, C., Fonseca, A., Lara, A., Alvarado, V., Urrecheaga, K., Ranson, A. and Mendoza, H., "Opportunities of Downhole Dielectric Heating in Venezuela: Three Case Studies Involving Medium, Heavy and Extra-Heavy Crude Oil D Reservoirs" SPE78980, presented at the 2002 SPE International Thermal Operations and Heavy Oil Symposium and International Horizontal Well Technology Conference held in Calgary, Alberta, Canada, Nov. 4-7, 2002, pp. 1-10.
Rice, S.A., Kok, A.L. and Neate, C.J., "A Test of the Electric Heating Process as a Means of Stimulating the 27 Productivity of an Oil Well in the Schoonebeek Field", CIM 92-04 presented at the Cim 1992 Annual Technical Conference in Calgary, Jun. 7-10, 1992, pp. 1-16.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000, pp. 1-10.
Sayakhov, F.L., Kovaleva, L.A. and Nasyrov, N.M., "Special Features of Heat and Mass Exchange in the Face Zone of /N.B./ 29 Boreholes upon Injection of a Solvent with a Simultaneous Electromagnetic Effect", Journal of Engineering Physics and Thermophysics, 71(1), 1998, pp. 161-165.
Spencer, H.L., Bennett, K.A. and Bridges, J.E. "Application of the Iitri/Uentech Electromagnetic Stimulation Process iN.B.i 30 to Canadian Heavy Oil Reservoirs" Paper 42, Fourth International Conference on Heavy Oil Crude and Tar Sands, UNITARIUNDP, Edmonton, Alberta, Canada, Aug. 7-12, 1988, pp. 1-8.
Sresty, G.C., Dev, H., Snow, R.H. and Bridges, J.E., "Recovery of Bitumen from Tar Sand Deposits with the Radio Frequency Process", SPE Reservoir Engineering, Jan. 1986, pp. 85-94.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 2000, pp. 25-29.
Schelkunoff, S.K. and Friis, H.T., "Antennas: Theory and Practice", John Wiley & Sons, Inc., London, Chapman Hall, Limited, 1952, pp. 229-244, 351-353.
Gupta, S.C., Gittins, S.D., "Effect of Solvent Sequencing and Other Enhancement on Solvent Aided Process", Journal of Canadian Petroleum Technology, vol. 46, No. 9, Sep. 2007, pp. 57-61.
Deutsch, C.V., McLennan, J.A., "The Steam Assisted Gravity Drainage (SAGO) Process," Guide to SAGO (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada, pp. 1-14.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers,© 1986, pp. 1-57.
Marcuvitz, Nathan, Waveguide Handbook; 1986; Institution of Engineering and Technology, vol. 21 of IEE Electromagnetic Wave series,

(56) References Cited

OTHER PUBLICATIONS

ISBN 0863410588, Chapter 2.3, pp. 66-72, published by Peter Peregrinus Ltd. on behalf of the Institution of Electrical Engineers,© 1986. pp. 1-10.
Carlson et al., "Development of the IIT Research Institute RF Heating Process for In Situ Oil Shale/Tar Sand Fuel Extraction—An Overview", Apr. 1981, pp. 1-9.
A. Godio: "Open ended-coaxial Cable Measurements of Saturated Sandy Soils", American Journal of Environmental Sciences, vol. 3, No. 3, 2007, , XP002583544, pp. 175-182.
"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm), pp. 1-13.
Von Hippel, Arthur R., Dielectrics and Waves, Copyright 1954, Library of Congress Catalog Card No. 54-11020, Contents, pp. xi-xii; Chapter II, Section 17, "Polyatomic Molecules", Appendix C-E, New York, John Wiley and Sons, pp. 150-155, pp. 273-277.
"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045, pp. 1-17.
Sahni et al., "Electromagnetic Heating Methods for Heavy Oil Reservoirs," U.S. Department of Energy, Lawrence Livermore National Laboratory, May 1, 2000, UCL-JC-138802, pp. 1-10.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007, pp. 1-9.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
Kinzer, A Review of Notable Intellectual Property for In Situ Electromagnetic Heating of Oil Shale, Quasar Energy LLC, p. 1.
"Oil sands." Wikipedia, the free encyclopedia. Retrieved from the Internet from: http://en.wikipedia.org/w/index.php? title=Oil_sands &printable=yes, Feb. 16, 2009, pp. 1-14.
Sahni et al., "Electromagnetic Heating Methods for Heavy Oil Reservoirs." 2000 Society of Petroleum Engineers SPE/AAPG Western Regional Meeting, Jun. 19-23, 2000, pp. 1-12.
Power et al., "Froth Treatment: Past, Present & Future." Oil Sands Symposium, University of Alberta, May 3-5, 2004, pp. 1-29.
Flint, "Bitumen Recovery Technology A Review of Long Term R&D Opportunities." Jan. 31, 2005. LENEF Consulting (1994) Limited, Part 1, 100 pgs; Part 2, 110 pgs.
"Froth Flotation." Wikipedia, the free encyclopedia. Retrieved from the internet from: http://en.wikipedia.org/wiki/ Froth_flotation, Apr. 7, 2009, pp. 1-6.
"Relative static permittivity." Wikipedia, the free encyclopedia. Retrieved from the Internet from http://en.wikipedia.org/ w/index/ php?title=Relative_static_permittivity&printable=yes, Feb. 12, 2009, pp. 1-3.
"Tailings." Wikipedia, the free encyclopedia. Retrieved from the Internet from http://en.wikipedia.org/w/index.php? title=Tailings &printable=yes, Feb. 12, 2009, pp. 1-6.
United States Patent and Trademark Office, Non-final Office action issued in U.S. Appl. No. 12/396,247, dated Mar. 28, 2011, pp. 1-10.
United States Patent and Trademark Office, Non-final Office action issued in U.S. Appl. No. 12/396,284, dated Apr. 26, 2011, pp. 1-62.
Patent Cooperation Treaty, Notification of Transmittal of the International Search Report and The Written Opinion of the International Searching Authority, or the Declaration, in PCT/US201 0/025808, dated Apr. 5, 2011, pp. 1-12.
PCT International Search Report and Written Opinion in PCT/US2010/025765, Jun. 30, 2010, pp. 1-11.
PCT International Search Report and Written Opinion in PCT/US2010/025772, Aug. 9, 2010, pp. 1-16.
PCT International Search Report and Written Opinion in PCT/US2010/025763, Jun. 4, 2010, pp. 1-15.
PCT International Search Report and Written Opinion in PCT/US2010/025807, Jun. 17, 2010, pp. 1-15.
PCT International Search Report and Written Opinion in PCT/US2010/025804, Jun. 30, 2010, pp. 1-15.
PCT International Search Report and Written Opinion in PCT/US2010/025769, Jun. 10, 2010, pp. 1-15.
PCT Notification of Transmittal of the International Search Report and the Written Opinion of the International Searching Authority, or the Declaration, in PCT/US2010/025761, dated Feb. 9, 2011, pp. 1-13.
PCT Notification of Transmittal of the International Search Report and the Written Opinion of the International Searching Authority, or the Declaration, in PCT/US2010/057090, dated Mar. 3, 2011, pp. 1-10.

* cited by examiner

RF HEATING TO REDUCE THE USE OF SUPPLEMENTAL WATER ADDED IN THE RECOVERY OF UNCONVENTIONAL OIL

CROSS REFERENCE TO RELATED APPLICATIONS

This application is a divisional of Ser. No. 12/395,918 filed Mar. 2, 2009 now U.S. Pat. No. 8,128,786 and is related to U.S. patent application Ser. Nos. 12/396,247, 12/395,995, 12/395,945, 12/396,192, 12/396,021, 12/396,284, 12/396,057, and 12/395,953, filed on Mar. 2, 2009, each of which is incorporated by reference herein.

STATEMENT REGARDING FEDERALLY SPONSORED RESEARCH OR DEVELOPMENT

[Not Applicable]

BACKGROUND OF THE INVENTION

This disclosure relates to separation of bitumen and kerogen, which are highly viscous varieties of petroleum, from oil sands, tar sands, oil shale, and other sources of petroleum bound to a substrate, sometimes referred to as unconventional petroleum or oil. There are large reserves of such petroleum ore in North America that are underutilized due to the economic and environmental costs of extracting usable petroleum from these deposits. The current surface mining processes recover approximately 91% of the bitumen in the ore. It is desired to improve the bitumen yield and reduce production costs.

One approach to improve the bitumen recovery rate is to heat the process water, reducing the viscosity of the bitumen. The viscosity of bitumen is reduced by a factor of 10 by heating it from 40° C. to 67° C., and is further reduced by a factor of more than 2 by further heating it from 67° C. to 80° C. Froth diluted with naptha will experience similar viscosity decreases with increasing temperatures.

The throughput rate for settling tanks, settling devices, centrifuges, and cyclones is inversely proportional to viscosity. Increasing the bitumen temperature from 40° C. to 80° C. can increase settling rates by a factor of 20, or decrease the size of the smallest particles extracted by a factor of 4.5 for the same processing rates.

Nonetheless, it is not economically feasible to heat the entire process to 80° C., as this requires too much energy per barrel of extracted hydrocarbons. The bitumen is a minor constituent through much of the process, and a large amount of process water is used. Much of the process water leaves the system, either as liquid or as vapor, and much of the heat introduced is lost.

Current technology heats the entire process to a certain extent, and utilizes steam injection to increase the temperature of the slurry at certain process points where a higher temperature may improve process efficiency.

SUMMARY OF THE INVENTION

One aspect of the invention is equipment for separating bitumen from oil sand in a process stream. The equipment includes a slurrying vessel, a separation vessel, a deaerator, a particle remover, and a local area radio frequency applicator.

The slurrying vessel forms a slurry of oil sand ore in water. The slurrying vessel has an ore inlet, a water inlet, and a slurry outlet.

The separation vessel separates a bitumen froth from the slurry. The separation vessel has a slurry inlet, a bitumen froth outlet, a sand outlet, and a middlings outlet.

The deaerator removes air from the bitumen froth, forming a bitumen slurry. The deaerator has a bitumen froth inlet and a bitumen slurry outlet.

The particle remover removes foreign particles from the bitumen slurry. The particle remover has a bitumen slurry inlet, a bitumen slurry outlet, and a sludge outlet.

The local area radio frequency applicator has an RF-AC power inlet and a radiating surface configured and positioned to selectively heat the process stream in a local area of the equipment. The local area can be adjacent to: the ore inlet of the slurrying vessel; the slurry outlet of the slurrying vessel; the slurry inlet of the separation vessel; the bitumen froth outlet of the separation vessel; the bitumen froth inlet of the deaerator; the bitumen slurry inlet of the particle remover; the sludge outlet of the particle remover; or any two or more of these locations.

Another aspect of the invention is bitumen froth separation equipment for processing oil sands. The equipment includes a separation vessel and a local area radio frequency applicator.

The separation vessel has a slurry inlet, a bottoms outlet, a middlings outlet above the bottoms outlet, and a bitumen froth outlet above the middlings outlet.

The local area radio frequency applicator is located at or adjacent to the bitumen froth outlet of the separation vessel. The applicator has an RF-AC power inlet and a radiating surface. The radiating surface is configured and positioned to selectively heat bitumen froth, without significantly heating middlings. This condition can be achieved when the vessel contains middlings at and adjacent to the level of the middlings outlet and bitumen froth above the middlings, at and adjacent to the level of the bitumen froth outlet.

Another aspect of the invention is equipment for processing an oil sand—water slurry, including a slurrying vessel, a slurry pipe, and a local area radio frequency applicator.

The slurrying vessel is configured to disperse oil sand ore in water, forming an alkaline oil sand-water slurry. The slurrying vessel has an oil sand ore inlet, a water inlet, and a slurry outlet.

The slurry pipe has an upstream portion 38 connected to the slurrying vessel outlet and a downstream portion located downstream of the slurrying vessel outlet.

The local area radio frequency applicator is located outside of the slurry pipe. The applicator has an RF-AC power inlet and a radiating surface configured and positioned to selectively heat the contents of the slurry pipe in a local area adjacent to the slurrying vessel outlet. The applicator heats the local area without significantly heating the contents of the slurrying vessel or of the downstream portion of the slurry pipe.

Yet another aspect of the invention is a process for separating bitumen from oil sand in a process stream, including the steps of forming a slurry of oil sand ore in water; separating a bitumen froth from the slurry; removing air from the bitumen froth, forming a bitumen slurry; removing foreign particles from the bitumen slurry; and applying radio frequency electromagnetic energy to a local area of the process stream.

The slurry of oil sand ore in water is formed in a slurrying vessel having an ore inlet, a water inlet, and a slurry outlet.

The bitumen froth is separated from the slurry in a separation vessel having a slurry inlet, a bitumen froth outlet, a sand outlet, and a middlings outlet.

Air is removed from the bitumen froth in a deaerator having a bitumen froth inlet and a bitumen slurry outlet.

Foreign particles are removed from the bitumen slurry in a particle remover. The particle remover has a bitumen slurry inlet, a bitumen slurry outlet, and a sludge outlet.

The radio frequency electromagnetic energy is applied a local area of the process stream to selectively heat the process stream in a local area. The local area can be adjacent to the slurry outlet of the slurrying vessel, the slurry inlet of the separation vessel, the bitumen froth outlet of the separation vessel, the bitumen froth inlet of the deaerator, the bitumen slurry inlet of the particle remover, or the sludge outlet of the particle remover. Local areas adjacent to any two or more of these locations can also be heated in this way.

BRIEF DESCRIPTION OF THE DRAWINGS

FIG. 10 is a diagrammatic plan view of the vessel of FIG. 9.

DETAILED DESCRIPTION OF THE PREFERRED EMBODIMENTS

The present invention will now be described more fully hereinafter with reference to the accompanying drawings, in which one or more embodiments of the invention are shown. This invention may, however, be embodied in many different forms and should not be construed as limited to the embodiments set forth herein. Rather, these embodiments are examples of the invention, which has the full scope indicated by the language of the claims. Like numbers refer to like elements throughout.

One aspect of the invention is equipment for separating bitumen from oil sands in a process stream. For convenience, "bitumen" is broadly defined here to include kerogen and other forms of petroleum bound to a substrate.

Figure 1A:
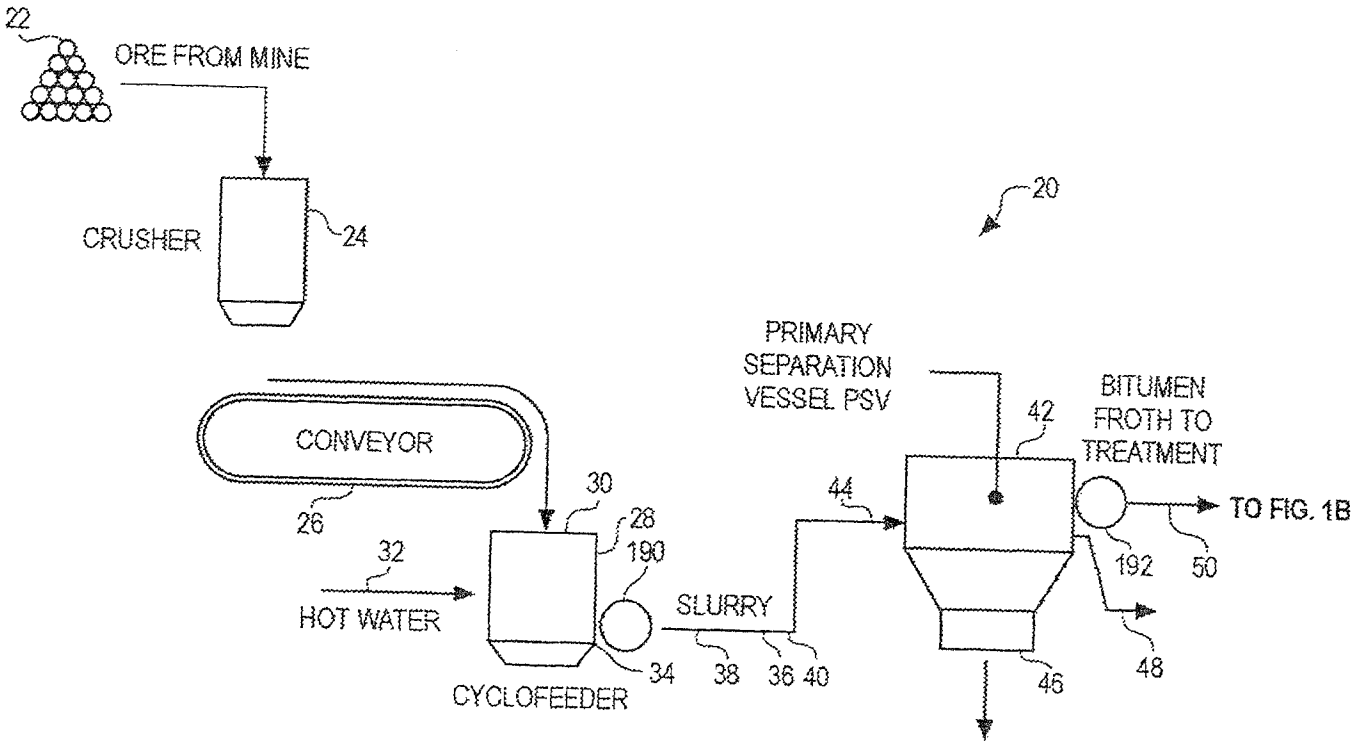
FIG. 1A, 1B, and 10 as a composite are a schematic view of a bitumen separation process for removing bitumen from oil sand ore.
Figure 1B:
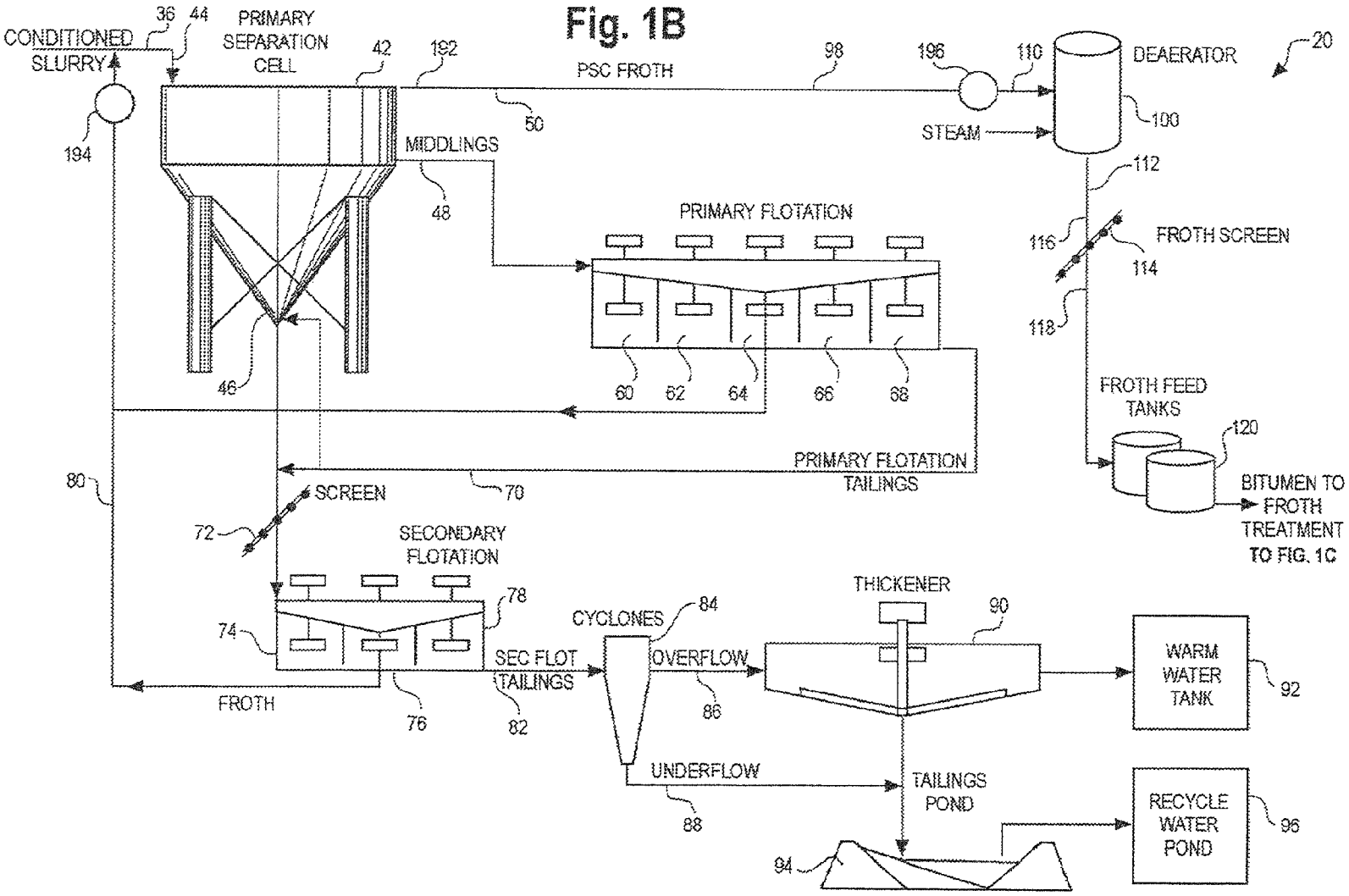
Figure 1C:
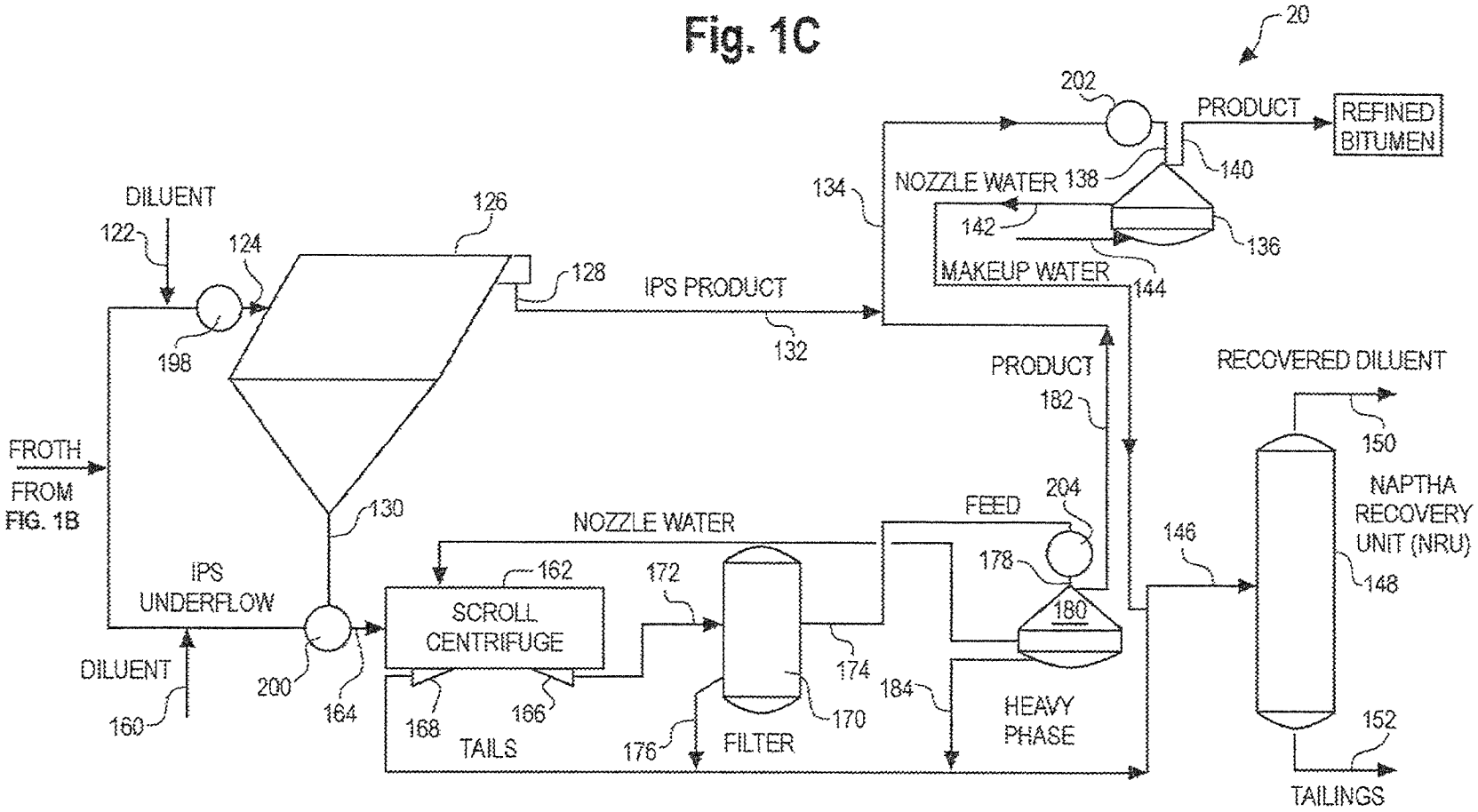

One example of equipment 20 for separating bitumen from oil sands is shown in FIGS. 1A, 1B, and 1C. Upstream of the equipment 20, ore 22 is dug from an oil sand mine, for example using a power shovel. The ore 22 can be conveyed, for example by dump trucks, to the equipment 20. The equipment 20 has a crusher 24 where the ore 20 is comminuted to a convenient size for processing. The crushed ore is placed on a conveyor 26, which conveys it into a slurrying vessel 28, such as a cyclofeeder.

The slurrying vessel 28 has an ore inlet 30, a water inlet 32, and a slurry outlet 34. Hot water is also conveyed to the slurrying vessel 28, where the crushed ore is dispersed in the water to form an oil sand ore slurry. The oil sand—water ore slurry is treated with sodium hydroxide to promote the separation of bitumen, and is conveyed to the slurry pipe 36.

The slurry pipe 36 has an upstream portion 38 connected to the slurrying vessel outlet and a downstream portion 40 located downstream of the slurrying vessel outlet 34.

The downstream portion 40 of the slurry pipe 36 feeds a primary separation vessel 42. The primary separation vessel 42 has a slurry inlet 44, a bottoms outlet 46, a middlings outlet 48 above the bottoms outlet 46, and a bitumen froth outlet 50 above the middlings outlet 48. The separation vessel 42 separates a bitumen froth and sand and other solid tailings from the slurry. The primary separation vessel 42 shown in FIG. 1 is a froth flotation vessel.

Figure 8:
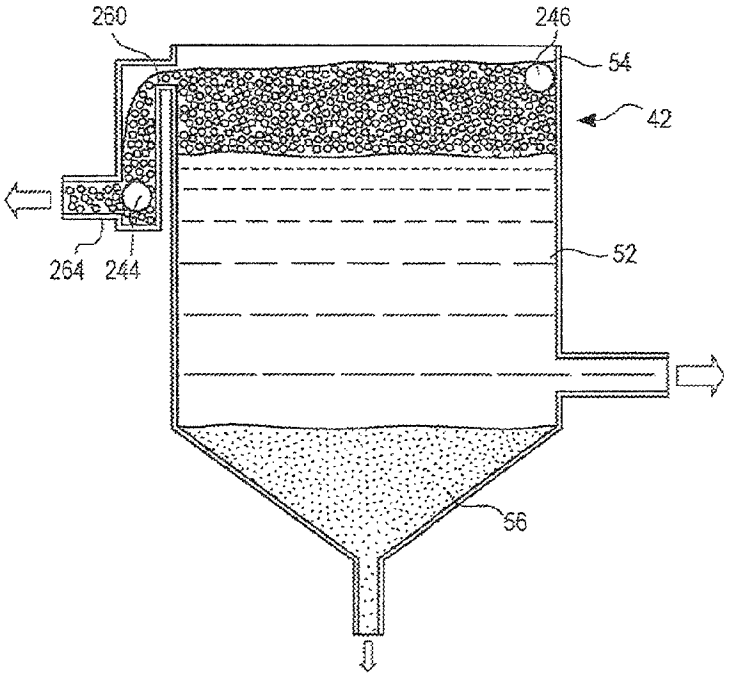
FIG. 8 is a diagrammatic section of a primary separation vessel.

In operation, with brief reference to FIG. 8, the middlings 52 are disposed in the separation vessel adjacent to the level of the middlings outlet 48. The middlings 52 consist essentially of an alkaline oil sand—water slurry. The bitumen froth 54 is disposed in the separation vessel above the middlings 52, adjacent to the level of the bitumen froth outlet 50. The liquid component of the bitumen froth 54 floated in the primary separation vessel 42 typically contains about 50-60% bitumen, 20-30% water, and 10-20% clay and other solids. The liquid component has a major volume of entrained air. The bottoms 56, predominantly sand, are disposed in the separation vessel 42 below the middlings 48 and at or adjacent to the level of the bottoms outlet 46.

As ore is processed, agitation of the middlings 52 introduces air that forms a froth. The bitumen particles escaping the sand to which they were originally bound adhere to the froth and rise to the top to form the bitumen froth 50, and the sand falls to the bottom 56, where it is removed through the sand outlet 46.

FIG. 1B, which repeats the primary separation vessel of FIG. 1A, shows that the middlings 52 of the primary separation vessel 42 can be removed via the middlings outlet 48 and further processed. As will be explained, the middlings 52 are removed as needed, typically continuously, to admit the feed from the slurry pipe 36 while leaving enough room at the top of the primary separation vessel 42 to hold the bitumen froth 54 for a sufficient dwell time to provide the desired proportion of bitumen in the froth 54.

The middlings 52 removed from the middlings outlet 48 are passed to one or more primary flotation vessels, here a bank of five parallel primary flotation vessels 60, 62, 64, 66, and 68, which again separate bitumen froth above and tailings below the oil sand emulsion middlings 52. The primary flotation tailings drained via the conduit 70 can be combined with the tailings from the primary separation vessel 42 for further processing.

FIG. 1B shows in more detail that the sand and tailings removed from the sand outlet 46 of the primary separation vessel or cell 42 and the conduit 70 can be screened at the screen 72 to remove larger particles and passed to secondary flotation vessels such as 74, 76, and 78 that provide secondary flotation of additional bitumen froth, which is recycled via the secondary bitumen froth line 80 to the input 44 of the primary separation vessel 42.

The tailings from the secondary flotation, conveyed by the secondary flotation tailings line 82, can be processed in one or more cyclones or secondary centrifuges 84 which separate a predominantly water overflow 86 and a particle sludge underflow 88. The water overflow can be cleared in a thickening vat 90, which separates further tailings from the water before directing the water to a warm water tank 92. The tailings separated by the thickening vat 90 are processed in a tailings pond 94, which further separates tailings from water before directing the water to a recycle water pond schematically shown as 96.

In the portion of the process shown in FIG. 1B, the bitumen froth from the primary separation vessel 42 is passed via a pipeline 98 to a deaerator 100. The deaerator 100 removes some of the air or other gas from the bitumen froth. The deaerator 100 has a bitumen froth inlet 110 and a bitumen froth outlet 112.

The slurry is then treated, commonly extensively, in particle removers to remove (typically) clay and other smaller particles that do not settle out in the flotation equipment. The particle removers typically have a bitumen slurry inlet, a bitumen slurry outlet, and a sludge outlet. Many different particle removers are suitable, and one or several of the illustrated particle separators can be used.

Referring to FIG. 1B, the first particle remover shown is a froth screen 114. The froth screen primarily removes relatively large particles from the bitumen froth. The screen 114 has a bitumen froth inlet 116 and a bitumen froth outlet 118. The sludge "outlet" of the screen 114 is further apparatus, not shown, that clears the screen 114. The sludge may also be removed by replacing a spent screen.

Referring now to FIGS. 1B and 1C, the bitumen slurry leaving the froth screen 114 proceeds to froth feed tanks 120 shown in FIG. 1B, and then the bitumen froth is diluted with additional fluid from a diluent stream 122 as shown in FIG. 1C and enters the bitumen froth feed inlet 124 of an inclined plate settler 126 also having a bitumen froth outlet 128 and a sludge outlet 130. The inclined plate settler 126 also has a flocculation chamber, lamella plate packs, overflow launders, a sludge hopper, a rake, and a flocculation agitator.

The processed bitumen froth leaves the inclined plate settler 126 via the bitumen froth outlet 128 and is conveyed via the bitumen froth lines 132 and 134 to a disk centrifuge 136 for additional particle removal. The secondary centrifuges for small particle removal operate in the range of 2500 g-5000 g, where g is the Earth's gravitational force at its surface. The disk centrifuge 136 has a bitumen froth inlet 138, a bitumen outlet 140, a diluent outlet 142, and a makeup water inlet 144. In the disk centrifuge 136, the bitumen in naphtha is the lighter fraction. It rises out of the centrifuge 136 to the bitumen outlet 140, and leaves the equipment as refined bitumen. Mineral particles and water drop to the bottom of the disk centrifuge 136 and exit in the nozzle water at the outlet 142. Makeup water is provided at 144 to replace the nozzle water.

The exiting nozzle water taken from the diluent outlet 142 is conveyed to the inlet 146 of a naphtha (diluent) recovery unit 148 that removes the diluent from the tailings to the diluent outlet 150. The tailings then exit through the tailings outlet 152 for disposal.

The underflow or sludge from the inclined plate settler 126, exiting via the sludge outlet 130, is mixed with a diluent stream 160, which can be a non-water solvent such naphtha, and passed through additional particle removal equipment shown in FIG. 1C and described below to isolate additional bitumen from the sludge.

The diluted sludge, which is a lower-content bitumen slurry, is passed to a scroll centrifuge 162 having a bitumen slurry inlet 164, a bitumen slurry outlet 166, and a tails outlet 168.

Additional bitumen slurry separated in the scroll centrifuge 162 is passed via the outlet 166 through a filter 170 having a bitumen slurry inlet, a bitumen or filtrate outlet, and a sludge outlet 176. The sludge outlet 176 of the filter can be a replaceable or cleanable filter element that is removed and/or cleaned to dispose of the sludge.

The bitumen slurry or filtrate leaving the bitumen outlet 174 of the filter is passed to the bitumen slurry inlet 178 of a disc centrifuge 180 having a bitumen slurry outlet 182 for passing the light phase, which can be bitumen in naphtha for example, and a sludge outlet 184 for passing the heavy phase, which can be tailings in water. The bitumen slurry passed through its outlet 182 is combined with the bitumen slurry leaving the inclined plate settler 126 and passed to the bitumen slurry inlet 138 of the disk centrifuge 136 for further processing as previously described.

The tails of the scroll centrifuge 162, optionally the filter 170, and the disk centrifuge 180 are combined and passed to the naphtha recovery unit 148 as previously described.

The bitumen in the froth or slurry being processed is very viscous, and its high viscosity makes processing less productive than optimal. If processed at a relatively cool temperature, the viscous bitumen does not readily settle or release the sand, and bitumen recovery is low. The inventors have found that this problem can be addressed by heating the slurry at certain process points to lower the viscosity of the bitumen.

The inventors contemplate that the conventional solution of injecting steam at certain process points to heat and thus decrease the viscosity of the bitumen has undesirable side effects. Steam injection, particularly when used to heat froth, tends to cause downstream process problems First, increasing the bitumen slurry temperature via steam injection adds additional water to the slurry, further diluting the bitumen, which requires more water to be processed in the equipment and ultimately adds to the water requiring removal from the bitumen. Since removal of a large volume of process water is already a problem, adding to the amount of water to be removed makes the process less efficient.

Second, the steam flow volume and pressure associated with steam injection are relatively high. Steam injection thus tends to result in high shear in the mixture, which in turn promotes the formation of more stable (i.e. hard to separate) oil-water emulsions in the process slurry or froth.

Third, the high shear contributed by steam injection tends to break up the particles of sand, clay, and the like in the slurry. These smaller particles are more difficult and time-consuming to remove. The throughput rate for settling tanks, settling devices, centrifuges, and cyclones decreases as the particle size decreases (for small particles). If the heating process creates more small particles or decreases mean particle sizes, as is likely to occur with the high shear of steam injection, the gains achieved by decreasing the bitumen viscosity are eroded or lost due to the greater difficulty of removing particles.

Fourth, since a froth is filled with small cells of air and thus conducts heat poorly, it is difficult to inject the steam in a way that uniformly heats the mass of froth.

Finally, the ore contains water as mined, which reduces the temperature of the heated ore slurry for a given energy input. The slurry mix temperatures achievable even by adding only 100° C., 1 atm water to the process tend to be limited for ores with high clay and water content.

Other heating solutions that do not add water, such as heat exchange from a hot water or steam conduit, are also not contemplated by the inventors to be useful because the bitumen slurry contains abrasive minerals and alkali, and so is very corrosive to process equipment. Materials that exchange heat efficiently, for example copper tubing, are unsuitable for exposure to this extreme environment.

The inventors contemplate that instead of injecting steam at certain process points for local heating, one or more of the process points or local areas can be heated by an applicator fed with radio-frequency (RF) energy. "Radio frequency" is most broadly defined here to include any portion of the electromagnetic spectrum having a longer wavelength than visible light, comprehending the range of from 3 Hz to 300 GHz, and includes the following sub ranges of frequencies:

| Name | Symbol | Frequency | Wavelength |
|---|---|---|---|
| Extremely low frequency | ELF | 3-30 Hz | 10,000-100,000 km |
| Super low frequency | SLF | 30-300 Hz | 1,000-10,000 km |
| Ultra low frequency | ULF | 300-3000 Hz | 100-1,000 km |
| Very low frequency | VLF | 3-30 kHz | 10-100 km |
| Low frequency | LF | 30-300 kHz | 1-10 km |
| Medium frequency | MF | 300-3000 kHz | 100-1000 m |
| High frequency | HF | 3-30 MHz | 10-100 m |
| Very high frequency | VHF | 30-300 MHz | 1-10 m |
| Ultra high frequency | UHF | 300-3000 MHz | 10-100 cm |
| Super high frequency | SHF | 3-30 GHz | 1-10 cm |
| Extremely high frequency | EHF | 30-300 GHz | 1-10 mm |

Referring to FIG. 1, several examples of local areas that can be RF heated include areas adjacent to one or more of the following process points ("Adjacent" a point for purposes of this description includes a location at that point, as well as a location removed a short distance from that point.):

- the areas such as 190 adjacent to the slurry outlet 34 of the slurrying vessel 28 (see also FIG. 2 for an enlarged view of the slurry vessel and FIGS. 3-7 for proposed RF applicators to heat the slurry pipe 36 of the slurry vessel);
- the areas such as 192 adjacent to the bitumen froth outlet 50 of the primary separation vessel 42 (see FIGS. 8-14 and 16 for exemplary heating points and process applicators);
- the areas such as 194 adjacent to the downstream end of the secondary slurry inlet 80 of the primary separation vessel 42 (See FIG. 1B for an exemplary heating point and FIGS. 3-7 for suitable RF applicators for heating this and other pipeline heating points);
- the areas such as 196 adjacent to the bitumen froth inlet 110 of the deaerator (see FIG. 1B for an exemplary heating point);
- the areas such as 198, 200, 202, or 204 adjacent to the bitumen slurry or froth inlets of one or more of the particle removers (see FIG. 1C); or
- the areas adjacent to any two or more of these locations.

Figure 3:
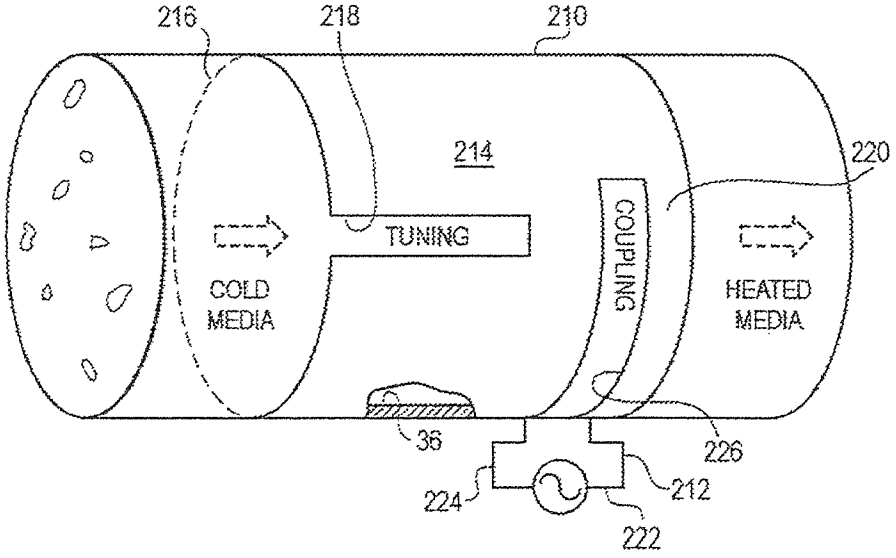
FIG. 3 is an isolated diagrammatic perspective view of a pipe segment and local area RF applicator for heating the contents of the pipe segment.
Figure 2:
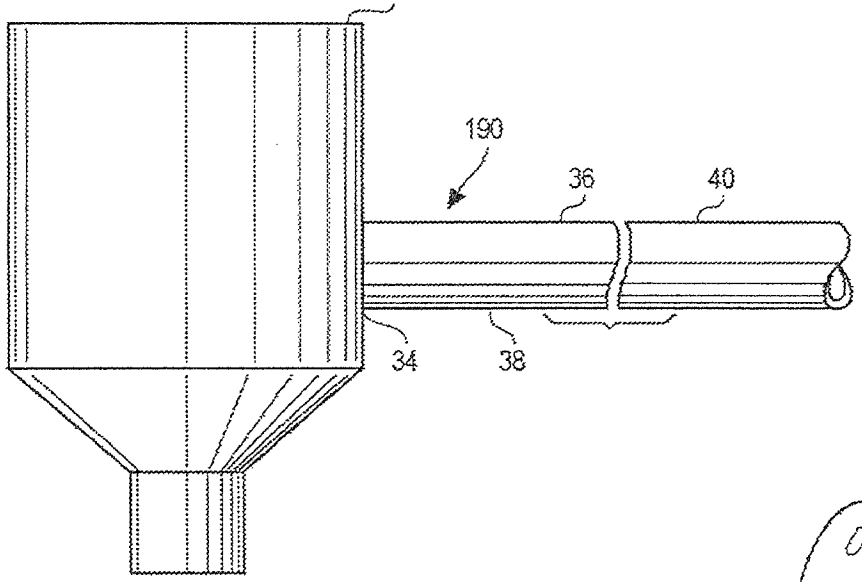
FIG. 2 is a perspective view of a slurrying vessel.

FIG. 3 shows an example of a suitable pipeline applicator 210 for heating the contents of a pipeline segment, such as the slurry pipe 36 of FIGS. 2 and 3. In FIG. 2, the local area is adjacent to the slurry outlet 34 of the slurrying vessel 28.

The local area radio frequency pipeline applicator 210 is located outside of the slurry pipe 36. The applicator 210 has an RF-AC power inlet 212 and a radiating surface configured and positioned to selectively heat the contents of the slurry pipe 36 in a local area adjacent to the slurrying vessel outlet. The applicator 210 heats the local area without significantly heating the contents of the slurrying vessel 28 or of the downstream portion 40 of the slurry pipe 36.

The local area radio frequency applicator of FIG. 3 is a slotted cylinder antenna 210, and can be constructed and operate according to the disclosure in U.S. Pat. No. 7,079,081 issued to Harris Corporation, which is incorporated here by reference.

The antenna 210 can include a radiating member 214. The radiating member 214 can be made from an electrically conductive material, for example copper, brass, aluminum, steel, conductive plating, and/or any other suitable material. In the present instance, a sheet or cast metal radiating member 214 is contemplated, for high power handling capability. Further, the radiating member 214 can be substantially tubular so as to provide a cavity 216 at least partially bounded by the conductive material. As defined herein, the term tubular describes a shape of a hollow structure having any cross sectional profile. In the present example, the radiating member 214 has a circular cross sectional profile, however, the present invention is not so limited. Importantly, the radiating member 214 can have any shape which can define a cavity 216 therein. Additionally, the radiating member 214 may be either evanescent or resonant.

The radiating member 214 can include a non-conductive tuning slot 218. The slot 218 can extend from a first portion of the radiating member 214 to a second interior portion of the radiating member 214. The radiating member 214 and/or the slot 218 can be dimensioned to radiate RF signals. The strength of signals propagated by the radiating member 214 can be increased by maximizing the cross sectional area of the cavity 216, in the dimensions normal to the axis of the radiating member 214. Further, the strength of signals propagated by the slot 218 can be increased by increasing the length of the slot 218. Accordingly, the area of the cavity cross section and the length of the slot can be selected to achieve a desired radiation pattern.

The antenna 210 also can include an impedance matching device 220 disposed to match the impedance of the radiating member 214 with the impedance of the load. According to one aspect of the invention, the impedance matching device 220 can be a transverse electromagnetic (TEM) feed coupler. Advantageously, a TEM feed coupler can compensate for resistance changes caused by changes in operational frequency and provide constant driving point impedance, regardless of the frequency of operation. A capacitor or other suitable impedance matching device can be used to match the parallel impedances of the radiating member 214 to the source and/or load.

If the impedance matching device 220 is a TEM feed coupler, the impedance matching performance of the TEM coupler is determined by the electric (E) field and magnetic (H) field coupling between the TEM coupler and the radiating member 214. The E and H field coupling, in turn, is a function of the respective dimensions of the TEM coupler and the radiating member 214, and the relative spacing between the two structures.

The impedance matching device 220 can be operatively connected to a source via a first conductor 222. For example, the first conductor 222 can be a conductor of a suitable cable, for instance a center conductor of a coaxial cable. A second conductor 224 can be electrically connected to the radiating member 214 proximate to the gap 226 between the radiating member 214 and the impedance matching device 220. The positions of the electrical connections of the second conductor 224 and first conductor 222 to the respective portions of the antenna can be selected to achieve a desired load/source impedance of the antenna.

Current flowing between the first conductor 222 and the second conductor 224 can generate the H field for coupling the impedance matching device 220 and the radiating member 214. Further, an electric potential difference between the impedance matching device 220 and the radiating member 214 can generate the E field coupling. The amount of E field and H field coupling decreases as the spacing between the impedance matching device 220 and the radiating member 214 is increased. Accordingly, the gap 226 can be adjusted to achieve the proper levels of E field and H field coupling. The size of the gap 226 can be determined empirically or using a computer program incorporating finite element analysis for electromagnetic parameters.

The local area radio frequency applicator of FIG. 3 is a slotted cylinder antenna 210 encircling a process conduit 36. The process conduit 36 can be a nonmetallic pipeline segment. It can be made, for example, of ceramic material that does not appreciably attenuate the RF energy transmitted through it to the ore sand slurry and is resistant to abrasion. In the illustrated embodiment, the slotted cylinder antenna 210 can be formed on the pipeline segment 36.

FIGS. 4-7 show another embodiment of a local area radio frequency applicator 230 suitable for heating a process stream 232 within the pipeline segment 36. The applicator here is a loop antenna 230 encircling the process conduit 36. Two or more axially or radially spaced loop antennas can optionally be provided. In the illustrated embodiment, the local area radio frequency applicator 230 is a Litz loop antenna. A suitable construction for a Litz loop antenna CaO be found, for example, in U.S. Pat. No. 7,205,947 issued to Harris Corporation, which is incorporated here by reference.

Figure 5:
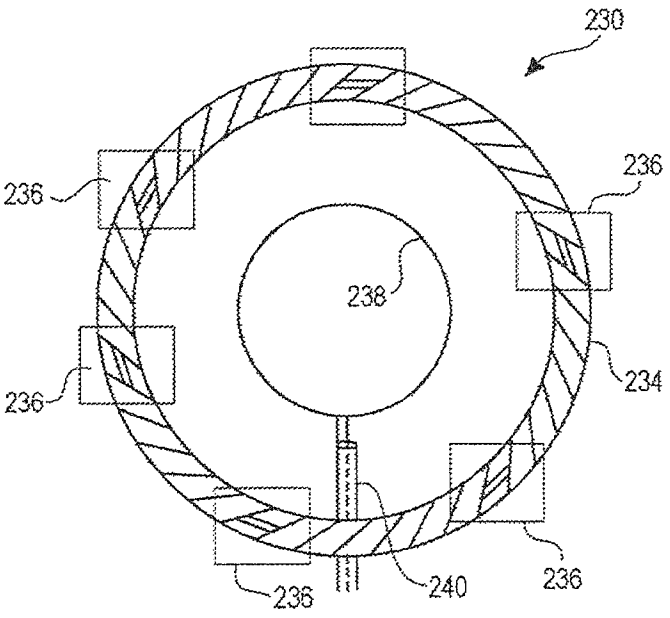
FIG. 5 is a schematic view of a Litz wire loop antenna.
Figure 4:
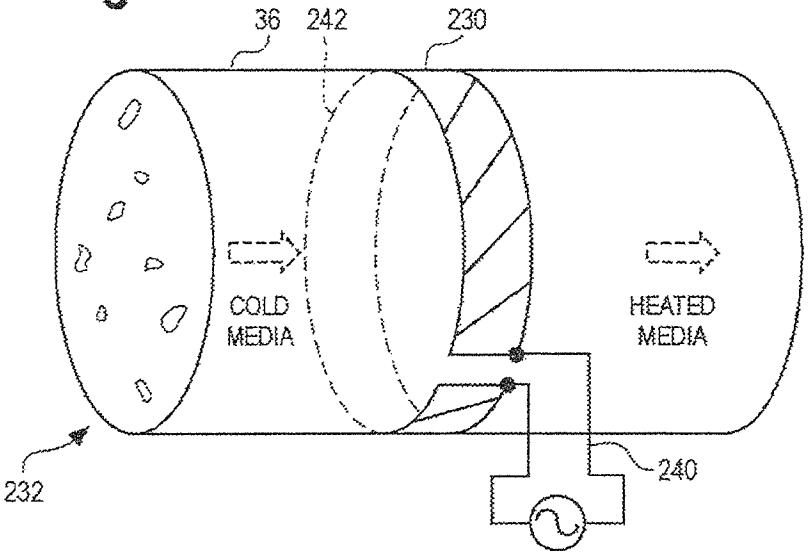
FIG. 4 is an isolated diagrammatic perspective view of another embodiment of a pipe segment and local area RF applicator for heating the contents of the pipe segment.
Figure 6:
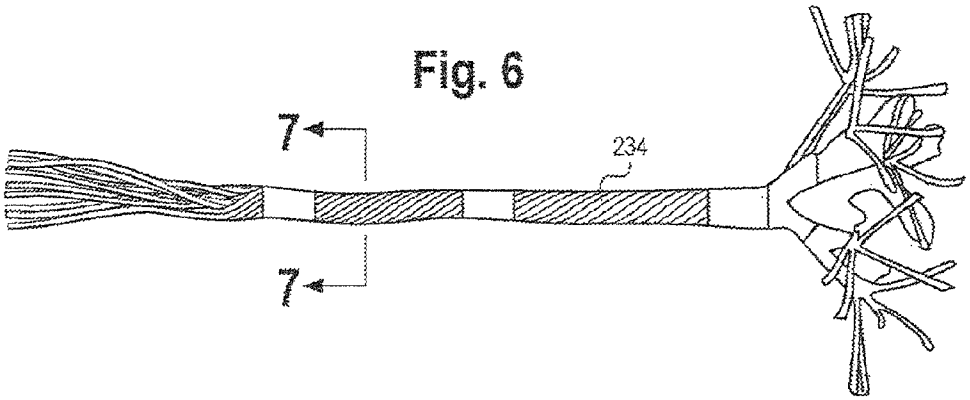
FIG. 6 is a perspective view of a Litz wire, partially disassembled to illustrate its construction.
Figure 7:
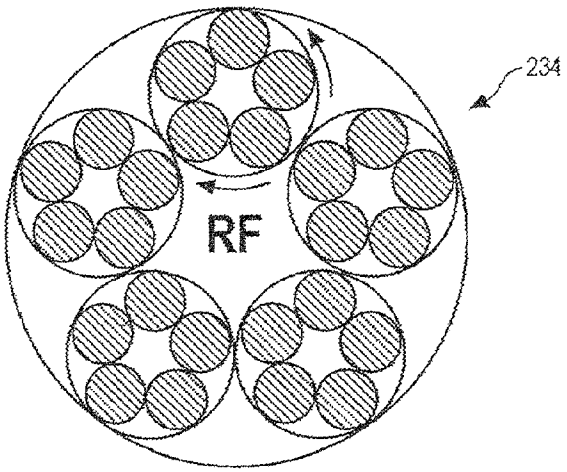
FIG. 7 is a section taken along section line 7-7 of FIG. 6.

The antenna of FIGS. 4 and 5 can be formed for example, from a Litz wire or wire cable 234 (commonly called a Litz wire 234), as illustrated in FIGS. 6 and 7. The term Litz wire is derived from the German word Litzendraht (or Litzendraught) meaning woven or "lace" wire. Generally defined, it is a wire constructed of individual film insulated wires bunched and twisted or braided together in a uniform pattern. Litz wire construction is designed to minimize or reduce the power losses exhibited in solid conductors due to the skin effect, which is the tendency of radio frequency current to be concentrated at the surface of the conductor. Litz constructions counteract this effect by being constructed, at least ideally, so each strand occupies all possible positions in the cable (from the center to the outside edge), which tends to equalize the flux linkages. This allows current to flow throughout the cross section of the cable. Generally speaking, constructions composed of many strands of finer wires are best for the higher frequency applications, with strand diameters of 1 to 2 skin depths being particularly efficient.

When choosing a Litz wire 234 for a given application, there are a number of important specifications to consider which will affect the performance of the wire. These specifications include the number of wire strands incorporated into the Litz wire 234, the frequency range of the wire, the size of the strands (generally expressed in AWG—American Wire Gauge), the resistance of the wire, its weight, and its shape (generally, either round, rectangular or braided).

Various Litz wire constructions are useful. For instance, the bundles may be braided and the cable twisted. In other instances, braiding or twisting may be used throughout.

Litz wire 234 can be served or unserved. Served simply means that the entire Litz construction is wrapped with a nylon textile, polyurethane, or yarn for added strength and protection. Unserved wires have no wrapping or insulation. In either case, additional tapes or insulations may be used to help secure the Litz wire 234 and protect against electrical interference. Polyurethane is the film most often used for insulating individual strands because of its low electrical losses and its solderability. Other insulations can also be used.

As shown in FIGS. 4 and 5, the antenna 230 includes a Litz wire loop 234. The Litz wire loop 234 includes splices 236 as capacitive elements or a tuning feature for forcing/tuning the Litz wire loop to resonance. Additionally, the frequency of the antenna 230 may be tuned by breaking and/or connecting various strands in the Litz wire loop 234. A magnetically coupled feed loop 238 is provided within the electrically conductive Litz wire loop 234, and forms a feed structure 240 to feed the magnetically coupled feed loop. The portion of the feed structure 240 leading to the feed loop 238 is preferably a coaxial feed line.

The loop 234 can be tuned by breaking and connecting selected wires of the plurality of wires in the Litz wire. For example, the operating frequency of a given Litz wire loop construction is first determined by measuring the lowest resonant frequency at the coupled feed loop 238. The operating frequency of the Litz wire loop 234 may then be finely adjusted upwards by randomly breaking strands throughout the Litz wire loop 234. The operating frequency of the Litz wire loop 234 is monitored at the coupled feed loop 238 to determine when the desired operating frequency is reached. The operating frequency may be adjusted downwards by reconnecting the broken strands.

The Litz wire loop 234 may be formed in many ways. In one manual technique, multiple long splices are made of individual wire bundles, as is common in the art of making continuous rope slings. One bundle is unraveled from the cable, and then another bundle laid into the void left by the previous bundle. The end locations of the multiple wire bundles are staggered around the circumference of the Litz wire loop 234. A core, such as the pipe of FIG. 4, can be used as a form for the Litz wire loop 234.

In operation, the magnetically coupled feed loop 238 acts as a transformer primary to the Litz wire loop 234, which acts as a resonant secondary, by mutual inductance of the radial magnetic near fields passing through the loop planes. The nature of this coupling is broadband.

In a pipeline applicator installation as illustrated in FIGS. 4 and 5, the feed loop 238 and the Litz loop 234 can have the same radius and be axially displaced along the pipe segment.

Referring to FIGS. 4 and 5, the local area radio frequency applicator has an RF-AC power inlet 240 and a radiating surface 242 configured and positioned to selectively heat the process stream 232 in a local area of the equipment 20.

Additional applicators as shown in FIG. 4 can be placed along the pipe segment 36 or other pipe segments in the equipment 20 to provide additional heating where elected.

Referring to FIGS. 8-14, other contemplated embodiments involve local heating of the bitumen froth in bitumen froth separation equipment for processing oil sands. The equipment includes a separation vessel 42 and a local area radio frequency applicator such as 244, 246, 248, 250, or 252.

The local area radio frequency applicators 244, 248, 250, and 252 are each located at or adjacent to the bitumen froth outlet 50 of a primary separation vessel 42. In the illustrated embodiments, the bitumen froth outlet comprises one or more of a weir 260 or 262 of the separation vessel (a well is broadly defined here as any edge, at or below the top of a container, over which the froth spills out when it rises above the level of the weir, such as a straight edge, the lip of a pipe, etc.), a launder such as 264 or 266 configured for collecting bitumen froth spilled from the weir, and a drain such as 268 in the launder such as 266 for draining the bitumen froth to downstream equipment for further processing.

Figure 10:
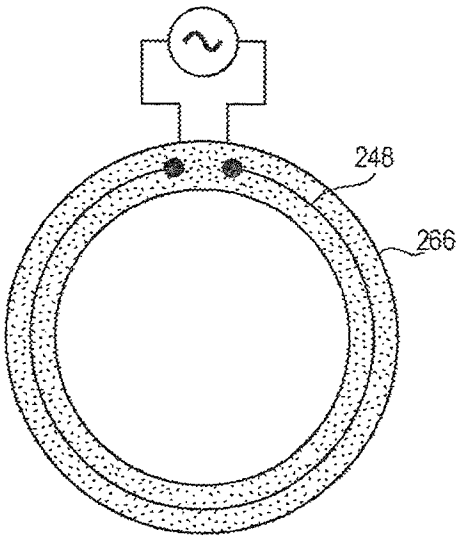
Figure 9:
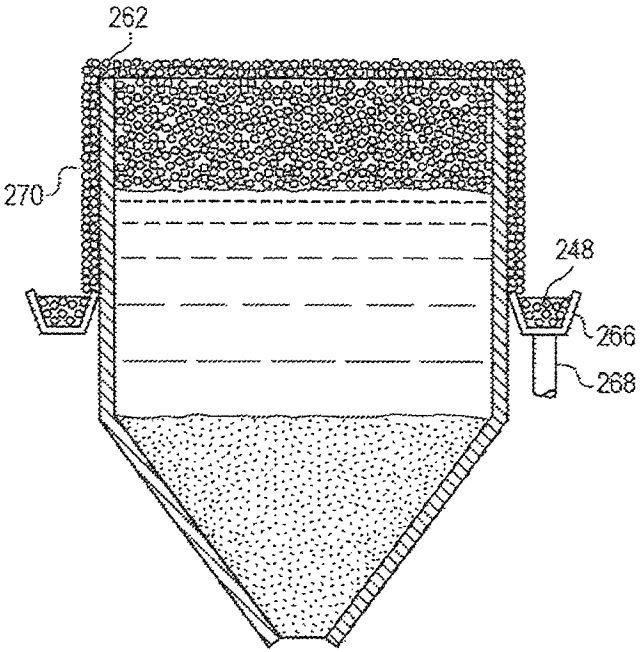
FIG. 9 is a diagrammatic section of a primary separation vessel having a launder.
Figure 11:
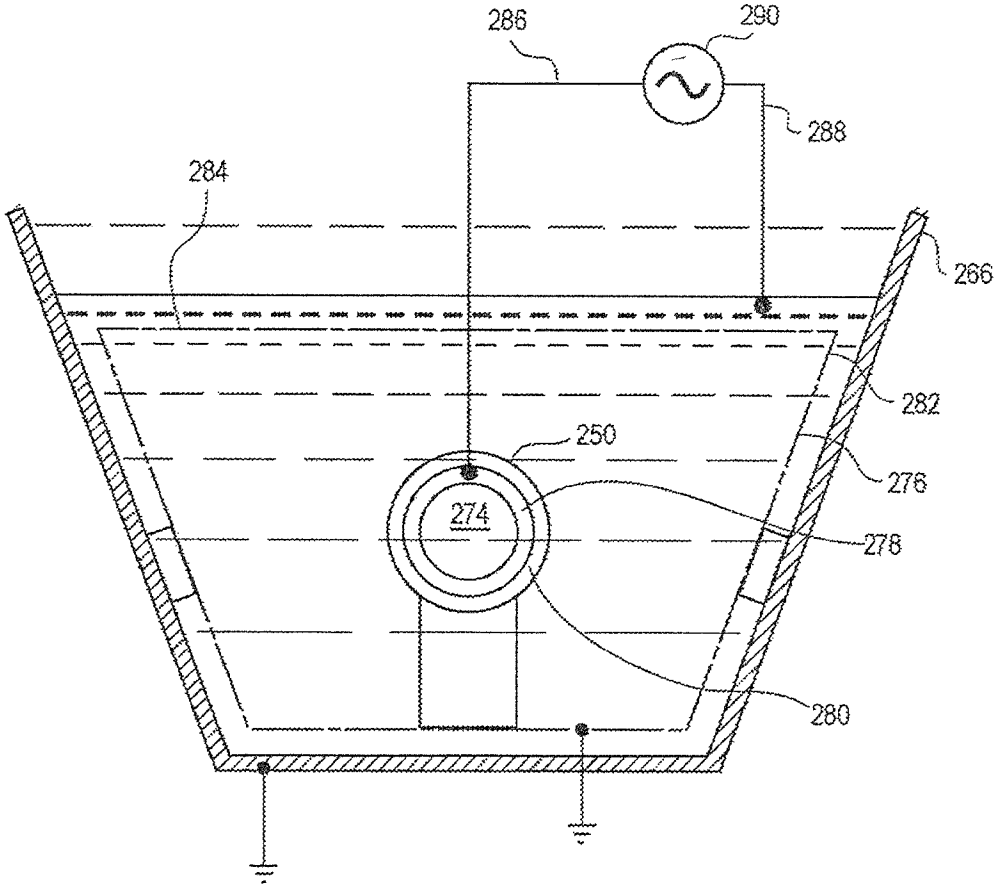
FIG. 11 is a sectional view of a launder of a primary separation vessel, showing a ring-and-grid RF applicator immersed in bitumen froth.

For example, the embodiment of FIGS. 9-11 provides local area heating in the launder 266 that collects the bitumen froth spillover 270 from the weir 262. The applicator 248 or 250 as illustrated is immersed in the bitumen froth, although a configuration near but outside the froth is also contemplated.

Figure 13:
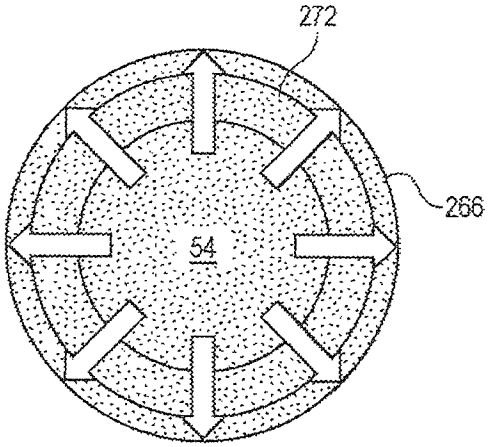
FIG. 13 is a diagrammatic plan view of the vessel of FIG. 12.
Figure 12:
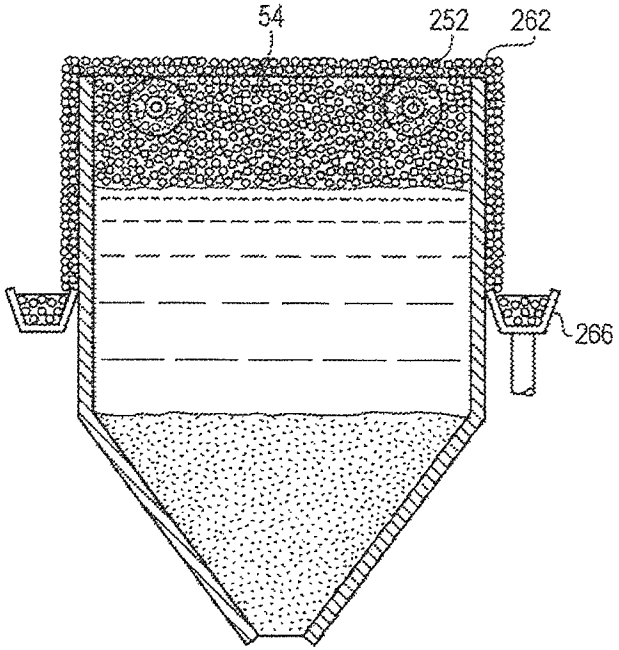
FIG. 12 is a view similar to FIG. 9, showing an RF applicator disposed in the bitumen froth within the primary separation vessel.

The applicator 252 of the embodiment of FIGS. 12 and 13 provides local area heating in the froth of the separation vessel itself, adjacent to the weir 262. Most or all of the froth 54 passes adjacent to the applicator 252 (either radially inside or outside the applicator 252) shortly before it reaches the weir 262, reducing the heated volume 272 of the froth 54 vertically and horizontally, as well as the heating time for a given volume of the froth, and thus keeping the heat loss from the froth 54 to a minimum.

As another example, a pipeline heater, such as any embodiment shown in FIGS. 3 through 5, can be applied to the downstream portion of the froth return 80 from the primary flotation vessels 60-68 and the secondary flotation vessels 74-78 to the main slurry line 36 entering the primary separation vessel 42. The entire oil sand slurry input at 44 could be heated, but that may not be necessary because the flow from the cyclofeeder 30 to the primary separation vessel 42 has already been heated by introducing hot water at 32 into the cyclofeeder. The froth return from the flotation vessels 60-68 and/or 64-68 may be considerably further downstream from the most recent application of heat.

The launder-mounted antenna 248 of FIGS. 9 and 10 can be a tubular or solid ring applicator as shown in FIG. 10 or 12, or a Litz loop antenna as shown in FIG. 5, or a ring-and-grid antenna as shown in FIG. 11.

The ring-and-grid antenna or applicator 250 as shown in FIG. 11 includes an electrically conductive tube, ring or ring segment 274, which can be a Litz wire for example, a grid 276 here shown as a tube-form grid surrounding the ring 274, an electrically non-conductive support 278 to maintain the ring segment in position and isolate it from other apparatus, and nonconductive exterior armoring and bracing 280 to isolate and protect the ring 274 and support 278 from the bitumen froth and other process conditions.

The ring or center conductor 274 of FIG. 11 alternatively can be configured as a TEM cavity or loop antenna, depending on the nature of the froth to be heated, the frequency to be used, and the geometry of the launder 266 and the grid 276. The cut-off frequency for TEM operation is governed by the medium permittivity and permeability. The ring 274 can be non-circular in cross-section, such as elliptical, rectangular, or arbitrary in shape, as for matching it to a non-circular trough or grid section.

The grid 276 is a mechanical exclusion grid, and has openings such as 282 that are small relative to the wavelength of the RF energy applied, to contain the RF field, but large enough to allow the bitumen froth to enter and leave the launder and the space enclosed by the grid easily. As an alternative, a flat grid such as just the top portion 284 can be provided above the ring, although preferably spanning the entire width of the launder 266 to prevent RF leakage. The grid 276 can be grounded to, or in common with, the launder trough.

RF energy can be introduced to the center conductor or ring 274 and the bitumen froth, as by the power leads 286 and 288 and the RF-AC source to power the applicator 250 of FIG. 11.

Figure 14:
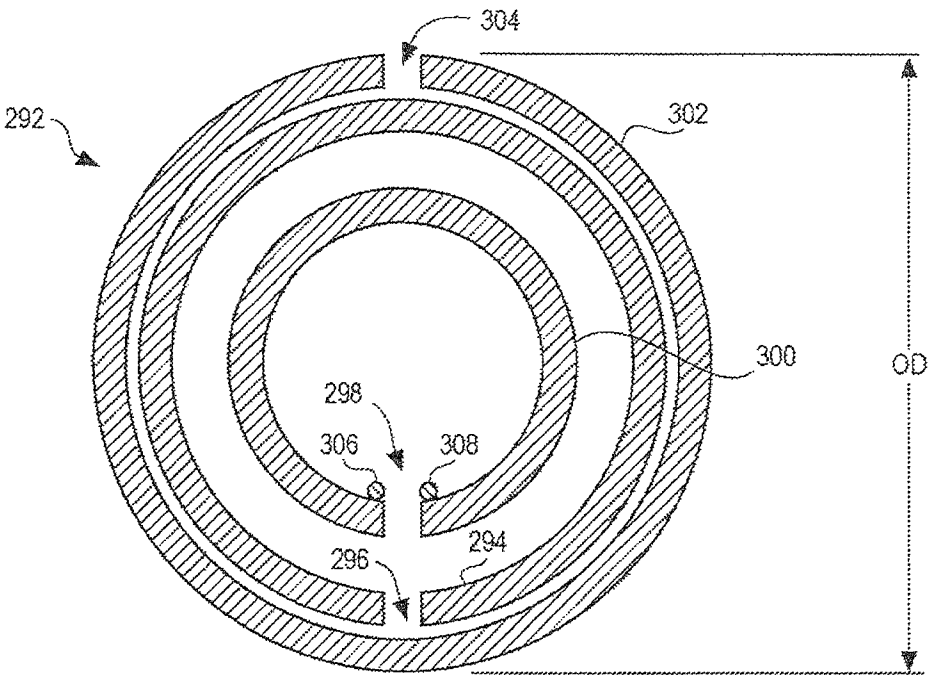
FIG. 14 is a schematic view of a modified loop antenna.

An example of a suitable RF ring antenna is the modified ring antenna shown in FIG. 14, as further described in U.S. Pat. No. 6,992,630 issued to Harris Corporation. That patent is incorporated here by reference.

Referring to FIG. 14, the antenna 292 includes an electrically conductive circular ring 294 on a substrate (not shown) and can be considered a loop antenna having about a one-half wavelength circumference in natural resonance.

The electrically conductive circular ring 294 includes a capacitive element 296 or tuning feature as part of its ring structure and preferably located diametrically opposite to where the antenna is fed, for forcing/tuning the electrically conductive circular ring 294 to resonance. Such a capacitive element 296 may be a discrete device, such as a trimmer capacitor, or a gap, in the electrically conductive circular ring 294, with capacitive coupling. Such a gap would be small to impart the desired capacitance and establish the desired resonance. The electrically conductive circular ring 294 also includes a driving or feed point 298 which is also defined by a gap in the electrically conductive circular ring 294.

The antenna 292 includes a magnetically coupled feed ring 300 provided within the electrically conductive ring 294. The magnetically coupled feed ring 300 has a gap therein, to define feed points 298 therefor, and diametrically opposite the capacitive element 296 or gap in the electrically conductive circular ring 294. In this embodiment, the inner magnetically coupled feed ring 300 acts as a broadband coupler and is non-resonant. The outer electrically conductive ring 294' is resonant and radiates.

Also, an outer shield ring 302 may surround the electrically conductive ring 294 and be spaced therefrom. The shield ring 302 has a third gap 304 therein. The outer shield ring 302 and the electrically conductive ring 294 both radiate and act as differential-type loading capacitors to each other. The distributed capacitance between the outer shield ring 302 and the electrically conductive ring 294 stabilizes tuning by shielding electromagnetic fields from adjacent dielectrics, people, structures, etc. Furthermore, additional shield rings 302 could be added to increase the frequency bands and bandwidth. Feed conductors 306 and 308 are provided to feed RF power to the applicator.

A method aspect of the embodiment of FIG. 14 includes making an antenna 292 by forming an electrically conductive circular ring 294, including forming an outer diameter of the electrically conductive circular ring to be less than 1/10 an operating wavelength, so the antenna is electrically small relative to the wavelength, and forming an inner diameter of the electrically conductive circular ring to be in a range of $\pi/6$ to $\pi/2$ times the outer diameter.

The applicators of FIGS. 8-14, if adapted to be immersed in the bitumen froth or other parts of the process stream, can be encased in a tubular ring of dielectric, corrosion and abrasion resistant material such as ceramic, and/or armored with a resistant coating such as carbide or chemical vapor deposited diamond, for example.

In each case, the applicator has an RF-AC power inlet and a radiating surface. The radiating surface is configured and positioned to selectively heat bitumen froth, without significantly heating middlings. This condition can be achieved when the vessel contains middlings adjacent to the level of the middlings outlet and bitumen froth above the middlings, adjacent to the level of the bitumen froth outlet.

Referring to FIGS. 8-13, the applicator can be at least generally concentric with the vessel. The local area radio frequency applicator can be an annular ring antenna positioned to be immersed in the process stream. Referring to FIGS. 8-11 and 16, the applicator can be at least partially outside the primary separation vessel 42. Referring to FIGS. 12-13 the applicator can be at least partially within the primary separation vessel 42.

Figure 16:
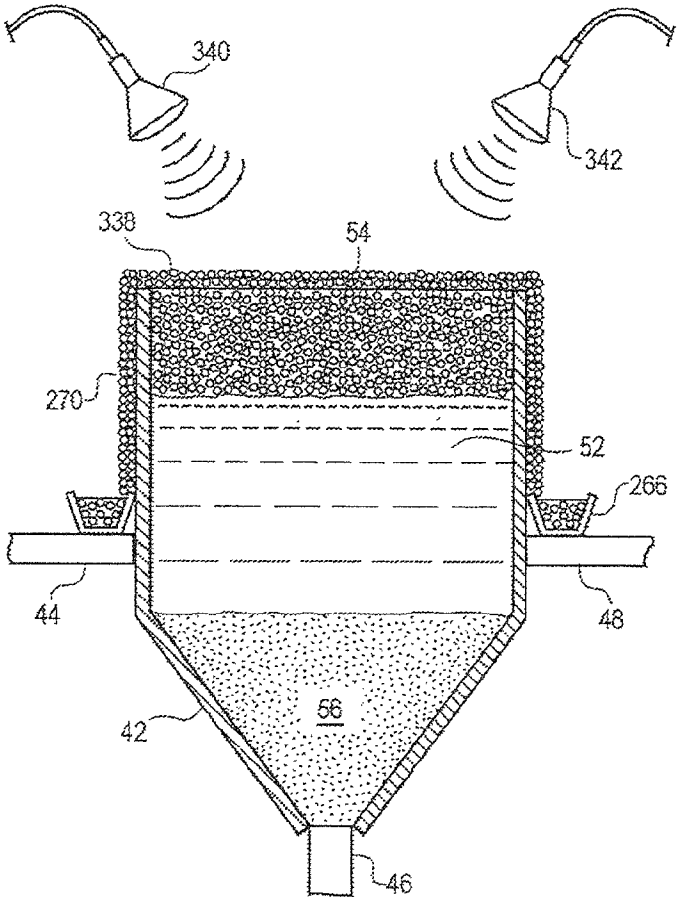
FIG. 16 is a diagrammatic section of a primary separation vessel having a launder and direct illumination RF heating.

FIG. 16 shows another embodiment of apparatus for local RF heating of the bitumen froth 54—non-contact illumination heating. In this embodiment. RF illumination is directed at the top surface 338 of the bitumen froth 54 by RF applicators 340 and 342 suspended above the primary separation vessel 42. The RF applicators 340 and 342 can be aimed to heat the top surface 338 generally or to heat specified portions of the top surface 338, such as near the edges of the top surface 338 for heating just prior to collection of the bitumen froth. The RF applicators 340 and 342 can also or alternatively be directed to the bitumen froth spillover 270 or the bitumen froth 54 in the launder 266 to heat the bitumen froth 54 just as it is leaving the primary separation vessel 42. The frequency and other characteristics of the RF applicators 340 and 342 can be selected to heat the water in the bitumen froth 54, which may contain 20-30% water. The air and bitumen hydrocarbons of the bitumen froth 54 are relatively transparent to most RE radiation, but water is a good susceptor, particularly if it contains dissolved solids such as sodium hydroxide that increase its conductivity. The water in the froth can be heated, and that heat can readily be conducted to the bitumen in close contact with the water in the bitumen froth 54.

Figure 15:
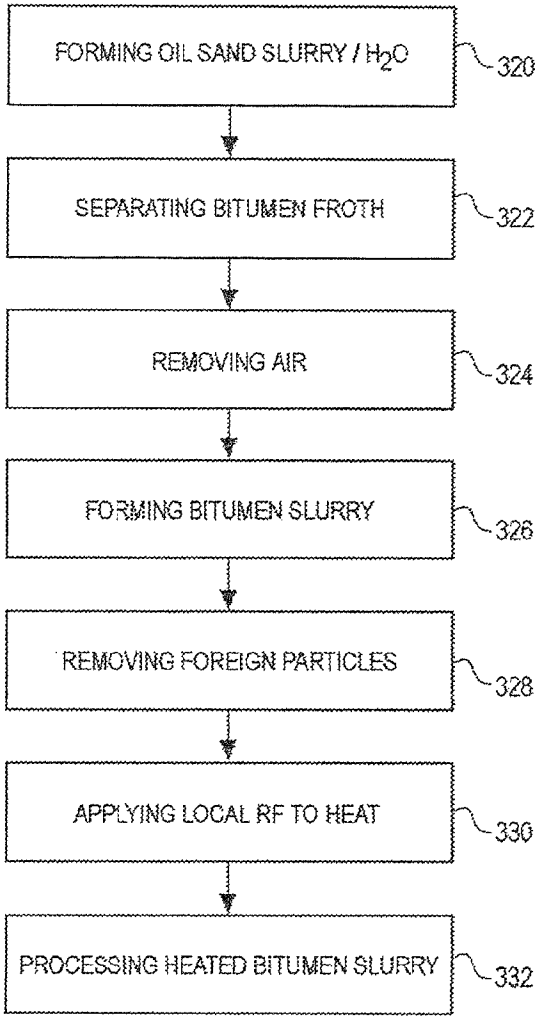
FIG. 15 is a process schematic for carrying out a contemplated process of oil sand ore processing.

Yet another aspect disclosed, for example, in FIG. 15 is a process for separating bitumen from oil sand in a process stream, including the steps of forming a slurry of oil sand ore in water, shown as 320; separating a bitumen froth from the slurry, shown as 322; removing air from the bitumen froth, shown as 324; forming a bitumen slurry, shown as 326; removing foreign particles from the bitumen froth and/or slurry, shown as 328; applying radio frequency electromagnetic energy to a local area of the process stream, shown as 330; and processing the thus-locally-heated bitumen slurry or froth process stream, shown as 332.

The radio frequency electromagnetic energy is applied a local area of the process stream to selectively heat the process stream in a local area. The local area can be, for example, any of those previously illustrated. Local areas adjacent to any two or more of these locations can also be heated in this way.

This use of RF heating provides a process-compatible, easily controlled method of heating that does not add any water, and it eliminates or alleviates at least some of the problems associated with steam transport and injection.

Figure 18:
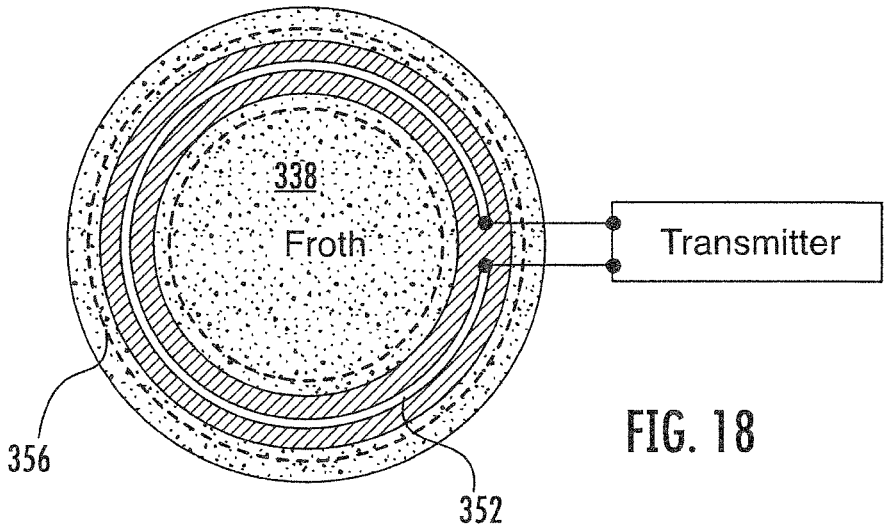
FIG. 18 is a plan view of the embodiment of FIG. 17.
Figure 17:
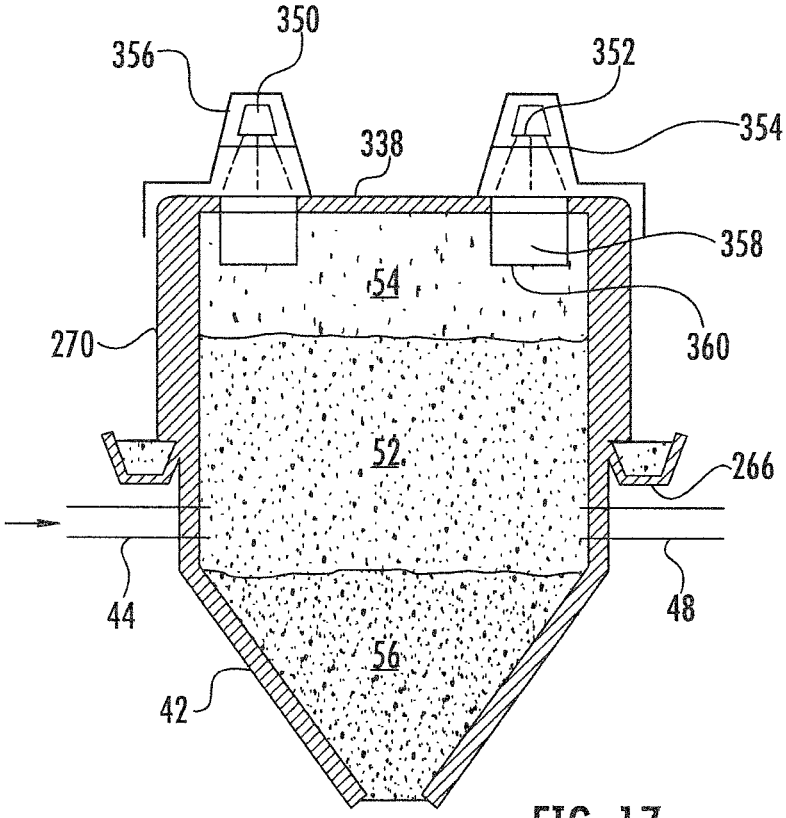
FIG. 17 is a diagrammatic section of another embodiment of a primary separation vessel having a launder and direct illumination RF heating.

Referring now to FIGS. 17 and 18, a second embodiment of non-contact direct illumination RF illumination equipment is shown, installed for use with a primary separation vessel 42 otherwise similar to the embodiment of FIG. 16. This direct illumination embodiment shown in FIGS. 17 and 18 again provides froth heating that requires no contact with froth, which can reduce or entirely eliminate problems associated with froth gumming of the RF antenna.

In this embodiment, the applicator 350 comprises a generally ring-shaped antenna 352 positioned above but adjacent to the bitumen froth surface 338 adjacent to the edges of the primary separation vessel 42. The antenna 352 is housed in an enclosure including an RF-transparent illuminating window 354 and a Faraday shield 356. This enclosure protects the antenna 352 and contains RF fields for safety. Heating at the top surface 338 of the bitumen froth 54 heats the froth to ease the separation of particles downstream of the primary separation vessel 42, and also makes the froth flow more freely to the collection trough.

Depending on the particulars of the system the system is applied to, the antenna 350 can be an array of a wide variety of antenna types including discrete dipoles, a planar array of radiating elements, an array of resonant cavities, Harris slot antennas, or a linear parabolic reflecting antenna with the linear parabolic reflector formed into a ring as shown. The antenna design, selection of operating frequency, and knowledge of the real and imaginary components of dielectric permittivity vs. frequency can be used to adapt the antenna 350 to provide a controlled heating depth and result in heating primarily the froth 54, or primarily an upper portion of the froth 54, such as the region 358 above the depth 358 within the froth 54.

To develop an appropriate antenna 350 and RF source 362 for this use, the characteristics of the froth 54 as a load can be pre-characterized to provide the data required to select an appropriate operating frequency, design the antenna for proper illumination, and perform the automatic impedance bridging function required to operate a working system.

This type of antenna 350 can also be applied to heat the top surface of bitumen froth in the launder 266, or can be applied in linear fashion to any form of transporting trough.

Figure 19:
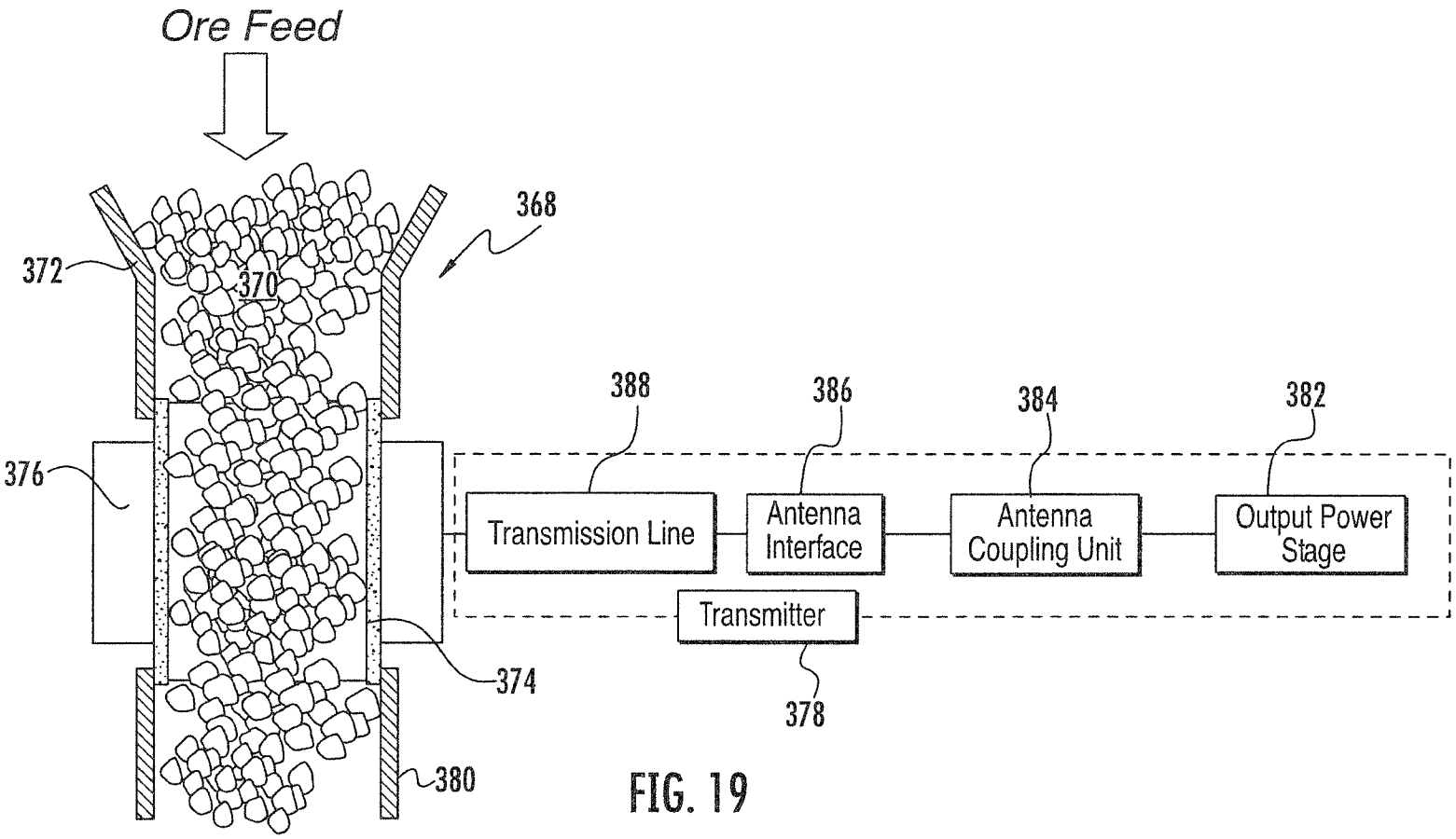
FIG. 19 is a diagrammatic section of an RF heater for heating ore.

FIG. 19 shows direct ore RF heating equipment 368 that can be used to heat the crushed ore 370 as it passes from the conveyor 26 en route to the cyclofeeder 30 of FIG. 1A. In this embodiment, the water already present in the crushed ore 370 before slurrying can be used as a susceptor to receive RF energy, heating the water in the crushed ore 370 directly, thus heating the bitumen in the crushed ore 370 indirectly.

This equipment 368 can include a feed chute 372 receiving material from a conveyor such as 26, an RF transparent pipe segment or sleeve 374, an antenna 376, an RF transmitter 378, and an output chute 380 for sending heated ore 370 to further process equipment such as the cyclofeeder 30. The sleeve 374 can be made of a suitable material that is durable and RF transparent, for example ceramic. The antenna 376 can be provided in various suitable forms including a Harris Litz antenna, a slotted array antenna, a circular resonant cavity array, or other configurations. The transmitter 378 includes an output power stage 382, and antenna coupling unit 384, an antenna interface 386, and a transmission line 388. In certain situations, the function of a transmission line 388 might be served by a wave guide, although it is contemplated that in the usual case a transmission line 388 will be used.

Thus, a system, apparatus, and process has been described that can provide one or more of the following optional advantages in certain embodiments.

The temperature of the process can be raised in selected areas of the equipment, providing better bitumen recovery, without adding additional water. This saves the energy that would otherwise be used to remove the additional water, and reduces the amount of energy expended by heating additional process water.

The temperature of the process also can be raised without introducing high shear flows or creating undesirable stable emulsions, as occur when steam injection is used.

Process pipelines optionally can be heated either with or without contact between the heating apparatus and the process slurry or froth.

A mechanically open TEM cavity can be used as the applicator, allowing substantially uniform heating throughout the bulk of the material, in situations where uniform heating is contemplated.

As an alternative, RF heating allows the selective application of heat to a surface layer of froth floating at the top of a primary separation vessel, without the need to heat the whole vessel and its contents of middlings and sand.

A Litz wire antenna has been provided for eddy current heating of bitumen and bitumen froth in pipes.

A slotted antenna has been provided for induction heating and dielectric loss heating of bitumen slurry in pipes.

Other features and advantages of the presently disclosed apparatus, systems and methods will be apparent to a person of skill in the art, upon review of this specification.

We claim:

1. A method for separating bitumen from ore in a process stream comprising:

forming a slurry of ore in a slurrying vessel;

separating a bitumen froth from the slurry of ore in a separation vessel;

removing gas from the bitumen froth in a deaerator thereby forming a bitumen slurry;

removing foreign particles from the bitumen slurry in a particle remover; and applying radio frequency (RF) energy to a local area of the process stream using a local area RF applicator having an RF-AC power inlet and a radiating surface adjacent at least one port of the slurrying vessel, separation vessel, deaerator, or particle remover.

2. The method of claim 1 wherein the at least one port comprises at least one inlet port.

3. The method of claim 1 wherein the at least one port comprises at least one outlet port.

4. The method of claim 1 wherein the local area RF applicator is within a process conduit between respective ports.

5. The method of claim 4 wherein the local area RF applicator comprises an annular ring antenna.

6. The method of claim 1 wherein the local area RF applicator surrounds a process conduit between respective ports.

7. The method of claim 6 wherein the local area RF applicator comprises a loop antenna.

8. The method of claim 6 wherein the local area RF applicator comprises a Litz loop antenna.

9. The method of claim 6 wherein the local area RF applicator comprises an annular ring antenna.

10. The method of claim 6 wherein the local area RF applicator comprises a slotted cylinder antenna.

11. The method of claim 1 wherein the ore comprises oil sand ore.

12. A method for separating bitumen from ore in a process stream comprising:

forming a slurry of ore in a slurrying vessel;

separating a bitumen froth from the slurry of ore in a separation vessel;

removing gas from the bitumen froth in a deaerator thereby forming a bitumen slurry;

removing foreign particles from the bitumen slurry in a particle remover; and applying radio frequency (RF) energy to a local area of the process stream in a process conduit using a local area RF applicator having an RF-AC power inlet and a radiating surface for at least one of the slurrying vessel, separation vessel, deaerator, and particle remover.

13. The method of claim 12 wherein the local area RF applicator comprises an annular ring antenna.

14. The method of claim 12 wherein the local area RF applicator surrounds the process conduit.

15. The method of claim 14 wherein the local area RF applicator comprises one of a loop antenna, a Litz loop antenna, an annular ring antenna, and a slotted cylinder antenna.

16. The method of claim 12 wherein the ore comprises oil sand ore.

17. A method for separating bitumen from ore in a process stream comprising:

forming a slurry of ore in a slurrying vessel;

separating a bitumen froth from the slurry of ore in a separation vessel;

removing gas from the bitumen froth in a deaerator thereby forming a bitumen slurry;

removing foreign particles from the bitumen slurry in a particle remover; and applying radio frequency (RF) energy to the bitumen froth using a non-contact RF applicator comprising a local area RF applicator having an RF-AC power inlet and a radiating surface.

18. The method of claim 17 wherein the non-contact RF applicator comprises an annular ring antenna positioned above the bitumen froth.

19. The method of claim 17 wherein the non-contact RF applicator comprises at least one of a dipole antenna, a planar array of radiating elements, an array of resonant cavities, a slot antenna, and a linear parabolic reflecting antenna.

20. The method of claim 17 wherein the ore comprises oil sand ore.

* * * * *